US010799753B2

(12) United States Patent
Koenig

(10) Patent No.: US 10,799,753 B2
(45) Date of Patent: Oct. 13, 2020

(54) SELECTIVELY ROTATING WEIGHT DEVICE AND RELATED SYSTEMS

(71) Applicant: Larry Koenig, Bondurant, IA (US)

(72) Inventor: Larry Koenig, Bondurant, IA (US)

(73) Assignee: Exodus Direct, L.L.C., Des Moines, IA (US)

( * ) Notice: Subject to any disclaimer, the term of this patent is extended or adjusted under 35 U.S.C. 154(b) by 0 days.

(21) Appl. No.: 16/007,657

(22) Filed: Jun. 13, 2018

(65) Prior Publication Data

US 2019/0022451 A1 Jan. 24, 2019

Related U.S. Application Data

(63) Continuation-in-part of application No. 14/950,959, filed on Nov. 24, 2015, now Pat. No. 10,029,142.

(Continued)

(51) Int. Cl.
*A63B 21/075* (2006.01)
*A63B 21/06* (2006.01)

(Continued)

(52) U.S. Cl.
CPC ..... *A63B 21/075* (2013.01); *A63B 21/0608* (2013.01); *A63B 21/072* (2013.01);

(Continued)

(58) Field of Classification Search
CPC ... A63B 15/00; A63B 15/005; A63B 21/0004; A63B 21/00058; A63B 21/00061; A63B 21/00065; A63B 21/00069; A63B 21/00072; A63B 21/06; A63B 21/0608; A63B 21/062; A63B 21/0622; A63B 21/0624; A63B 21/0626; A63B 21/0628; A63B 21/063; A63B 21/0632; A63B 21/065; A63B 21/068; A63B 21/072; A63B 21/0722; A63B 21/0724; A63B 21/0726; A63B 21/0728; A63B 21/075; A63B 21/08; A63B 21/15; A63B 21/159; A63B 21/22; A63B 21/4017; A63B 21/4019; A63B 21/4023; A63B 21/4033; A63B 21/4035; A63B 21/4043; A63B 21/4045; A63B 21/4049; A63B 23/035; A63B 23/03516; A63B 23/12; A63B 23/1209; A63B 23/1245; A63B 23/1254; A63B 23/1263; A63B 23/1272; A63B 23/1281; A63B 23/129; A63B 23/14; A63B 23/16;

(Continued)

(56) References Cited

U.S. PATENT DOCUMENTS 588,350 A * 8/1897 Perkins ..... A63B 21/0004 482/109
1,658,108 A * 2/1928 Vaughn ..... A63B 15/00 482/109

(Continued)

*Primary Examiner* — Gary D Urbiel Goldner
(74) *Attorney, Agent, or Firm* — Davis, Brown, Koehm, Shors & Roberts, P.C.

(57) ABSTRACT

A bi-bell exercise device for low-impact exercises. The bi-bell exercise device can be used in place of a kettle bell, and has two handles and a selectively rotatable weight. The bi-bell exercise device can be used in a fixed configuration, where the weight does not move relative to the handles, or a rotating configuration, where the weight is free to rotate relative to a central post.

9 Claims, 26 Drawing Sheets

Related U.S. Application Data

(60) Provisional application No. 62/123,661, filed on Nov. 24, 2014.

(51) Int. Cl.
*A63B 21/072* (2006.01)
*A63B 21/00* (2006.01)
*A63B 71/00* (2006.01)

(52) U.S. Cl.
CPC ..... *A63B 21/4035* (2015.10); *A63B 21/4043* (2015.10); *A63B 21/4049* (2015.10); *A63B 71/0054* (2013.01)

(58) Field of Classification Search
CPC ..... A63B 71/0054; A63B 2071/0072; A63B 2071/0081; A63B 2071/009; A63B 2225/09; A63B 2225/093
See application file for complete search history.

(56) References Cited

U.S. PATENT DOCUMENTS 2,470,816 A * 5/1949 Harvey ..... A63B 15/00 482/109
3,904,198 A * 9/1975 Jones ..... A63B 21/0724 482/106
4,252,316 A * 2/1981 Price ..... A63B 21/0728 482/106
4,345,756 A 8/1982 Hoagland
4,450,640 A 5/1984 Shapiro
4,537,394 A * 8/1985 Golinsky, Jr. ..... A63B 21/072 482/109
4,641,836 A 2/1987 Clifton
4,768,780 A * 9/1988 Hayes ..... A63B 21/0724 482/106
5,540,640 A 7/1996 Povilaitis
6,152,858 A 11/2000 Kolb
6,689,022 B1 2/2004 Emick
7,137,930 B1 11/2006 Carr
7,476,183 B1 1/2009 Chrest
7,789,814 B1 * 9/2010 Xu ..... A63B 21/0728 482/107
D653,715 S 2/2012 Tumminia
8,574,136 B1 * 11/2013 Burstrom ..... A63B 69/0057 482/108
9,028,378 B2 5/2015 Shah
9,364,734 B1 6/2016 Dixon, Jr.
9,504,866 B2 11/2016 Peralo
10,029,142 B2 * 7/2018 Koenig ..... A63B 21/075
2003/0100418 A1 5/2003 Domenge
2004/0063553 A1 4/2004 Viscount
2004/0162199 A1 8/2004 Connelly
2010/0029447 A1 2/2010 Song
2011/0177922 A1 * 7/2011 Selinger ..... A63B 21/0724 482/107
2012/0316012 A1 12/2012 Thackeray
2015/0024908 A1 1/2015 Hall
2015/0105224 A1 4/2015 Odneal
2016/0144219 A1 * 5/2016 Koenig ..... A63B 21/075 482/93

* cited by examiner

SELECTIVELY ROTATING WEIGHT DEVICE AND RELATED SYSTEMS

CROSS-REFERENCE TO RELATED APPLICATIONS

This application is a continuation-in-part of U.S. application Ser. No. 14/950,959, filed Nov. 24, 2015, which claimed priority to U.S. Provisional Application No. 62,123,661 filed Nov. 24, 2014, both of which are hereby incorporated by reference in their entirety.

TECHNICAL FIELD

The disclosure relates to apparatus, systems and methods relating to exercise and exercise devices for core fitness training. More specifically, the disclosure relates to a novel hand-held exercise device and associated systems and methods.

BACKGROUND

The disclosure relates to apparatus, systems and methods relating to a handheld exercise device for core fitness training.

Core fitness and cross training have recently become the foundation of most sports training programs. Currently, conventional devices such as kettle bells and sandbags have been utilized for a variety of cardiovascular, strength and endurance training exercises known in the art. However, these conventional devices have limitations in movement and safety.

There is a need in the art for improved exercise devices, systems and methods.

BRIEF SUMMARY

Described herein are various embodiments relating to devices, systems and methods relating to a bi-bell. In various embodiments, the bi-bell comprises two handles, a central post and a weight that can be variously fixed or free to rotate around the central post due to due to momentum, centrifugal, centripetal, gravitational or other forces for the performance of a variety of exercises. Although multiple embodiments are described herein as a "bi-bell," this is in no way intended to be restrictive.

One example includes a bi-bell including an elongate central post including a first post end and second post end, an elongate crossbar fixedly attached to the first post end and a first handle and second handle and a weight disposed adjacent to the second post end, where the weight is configured to be selectively rotatable relative to the elongate central post.

Another example includes a bi-bell training system for a user, including an elongate central post including a first post end and second post end an elongate crossbar fixedly attached to the first post end and including a first crossbar end and second crossbar end a first handle disposed at the first crossbar end a second handle disposed at the second crossbar end a rotatable collar dispose around the central post a collar flange disposed at the second central post end and a weight disposed adjacent to the second post end, where the weight is configured to be selectively rotatable relative to the elongate central post by way of the rotatable collar.

Yet another example includes A method of exercising, including providing a bi-bell including an elongate central post including a first post end and second post end an elongate crossbar fixedly attached to the first post end and including a first crossbar end and second crossbar end, a first handle disposed at the first crossbar end, a second handle disposed at the second crossbar end, a rotatable collar disposed around the central post, a collar flange disposed at the second central post end and a weight disposed adjacent to the second post end for performing an exercise.

Implementations may include one or more of the following features. The bi-bell further including a collar disposed about the central post. The bi-bell further including a collar fastener. The bi-bell further including a linkage disposed between the weight and collar. The bi-bell where the weight is removable. The bi-bell further including a collar stop flange disposed at the second end of the central post. The bi-bell further including at least one handle. The bi-bell training system further including a collar fastener. The bi-bell training system where the weight is removable. The bi-bell training system further including a collar fastener. The bi-bell training system where the first handle, second handle and central post are capable of being rested on the forearm of the user. The bi-bell training system further including a linkage disposed between the weight and the collar. The bi-bell training system where the linkage includes a first linkage end and a second linkage end, such that the weight can be fitted onto the linkage.

Implementations may include one or more of the following features. The bi-bell training system further including a collar fastener. The bi-bell training system where the weight is removable. The bi-bell training system further including a collar fastener. The bi-bell training system where the first handle, second handle and central post are capable of being rested on the forearm of the user. The bi-bell training system further including a linkage disposed between the weight and the collar. The bi-bell training system where the linkage includes a first linkage end and a second linkage end, such that the weight can be fitted onto the linkage. The method where the weight is able to rotate around the central post by way of the collar during the performance of the exercise. The method where the bi-bell further includes a collar fastener. The method where the bi-bell further includes a linkage fastener. The method further including providing a fixed configuration and a rotating configuration. The bi-bell training system further including a linkage fastener.

Implementations may include one or more of the following features The method where the weight is able to rotate around the central post by way of the collar during the performance of the exercise. The method where the bi-bell further includes a collar fastener. The method where the bi-bell further includes a linkage fastener. The method further including providing a fixed configuration and a rotating configuration. The bi-bell training system further including a linkage fastener.

While multiple embodiments are disclosed, still other embodiments of the disclosure will become apparent to those skilled in the art from the following detailed description, which shows and describes illustrative embodiments of the disclosed apparatus, systems and methods. As will be realized, the disclosed apparatus, systems and methods are capable of modifications in various obvious aspects, all without departing from the spirit and scope of the disclosure. Accordingly, the drawings and detailed description are to be regarded as illustrative in nature and not restrictive.

BRIEF DESCRIPTION OF THE DRAWINGS

FIG. 4B-2 depicts the user of FIG. 4B-1 having moved the bi-bell to a second position.

FIG. 4C-1 depicts a front and top view of a user and the bi-bell in use, according to an exemplary embodiment.

FIG. 4C-2 depicts the user and bi-bell of FIG. 4C-1 having moved the bi-bell to an alternate position.

FIG. 4C-3 depicts the user and bi-bell of FIG. 4C-1 having moved the bi-bell to a further position.

FIG. 5E-1 is a side view of the implementation of FIG. 5E, showing the handle in a rotated position.

DETAILED DESCRIPTION

The various apparatus, systems and methods disclosed herein relate to devices for use in fitness and exercise applications. More specifically, various embodiments relate to various exercise devices, including a bi-bell.

It is understood that the various embodiments of the bi-bell disclosed herein can be incorporated into or used with any other known exercise devices, systems and methods.

Figure 1A:
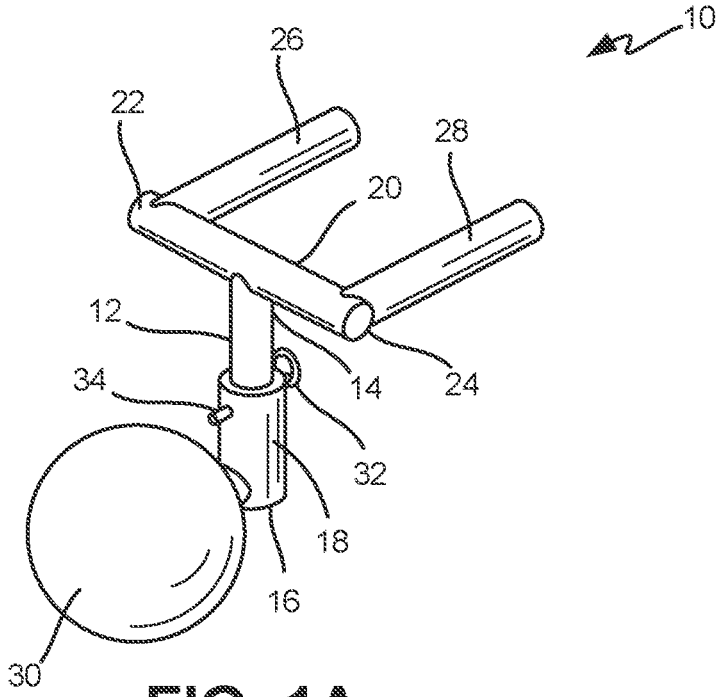
FIG. 1A is a perspective view of an exemplary embodiment of the bi-bell.

Turning to the drawings in greater detail, FIG. 1A depicts an exemplary embodiment of the bi-bell 10. In this embodiment, the bi-bell 10 comprises an elongate, cylindrical central post 12 having a first post end 14 and second post end 16. In the depicted embodiment, an elongate cylindrical collar 18 is disposed at the second post end 16 and substantially enclosing at least a portion of the central post 12. In this embodiment, the collar 18 is coaxial to the central post 12 and encloses, ensheaths, or otherwise surrounds a portion of the central post 12 so as to be capable of free rotation relative to the central post 12. The central post 12 and collar thus serve as inner and outer In exemplary embodiments, to promote the rotation of the collar 18 relative to the central post 12 conventional lubricants or mechanical methods of enhancing rotation can be used, such as bearings.

Continuing with FIG. 1A, the first post end 14 is fixedly attached to a crossbar 20. The crossbar further comprises a first crossbar end 22 and second crossbar end 24. In this embodiment, the first post end 14 is fixedly attached substantially at the middle of the crossbar. Further, a first handle 26 and second handle 28 are attached to the crossbar 20 at the first crossbar end 22 and second crossbar end 24, respectively. Accordingly, the collar 18 is capable of rotation around the second post end 16 (as is shown by the embodiment of FIG. 1B) in response to the urging by the weight 30 or central post 12, such that it can rotate or swing relative to the crossbar 20, first handle 26 and second handle 28 in use, as described below in relation to FIGS. 3A-4D.

Figure 1B:
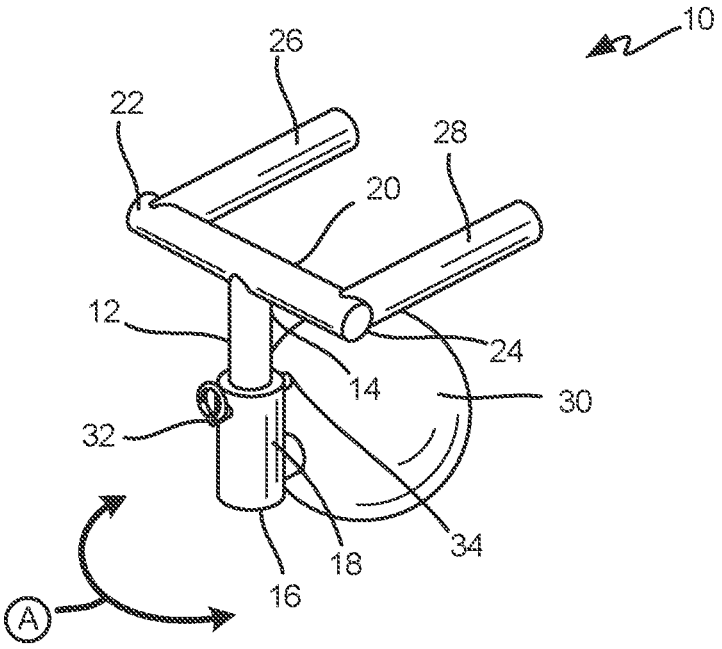
FIG. 1B is a perspective view of the bi-bell of FIG. 1A, with the weight rotated 180 degrees.

Continuing with FIGS. 1A-1B, a ballast or weight 30 is fixedly attached to the collar 18 so as to extend outward from the post opposite the first handle 26 and second handle 28. Further discussion of the weight 30 can be found in relation to FIGS. 1C-1D. As is also shown in FIG. 1A, in exemplary embodiments, the bi-bell 10 further comprises a collar fastener 32, such as a lynchpin, cam-lock, or other mechanical or physical fasteners which can be used to selectively prevent movement of the collar 18 relative to the central post. In certain embodiments, the collar fastener 32 is a lynchpin disposed through an opening 34 through the central post 12 and collar 18, as would be apparent to one of skill in the art. In FIG. 1B, the weight 30 has been rotated (designated by reference arrow A) so as to be oriented in a substantially similar direction as the first handle 26 and second handle 28.

Figure 1C:
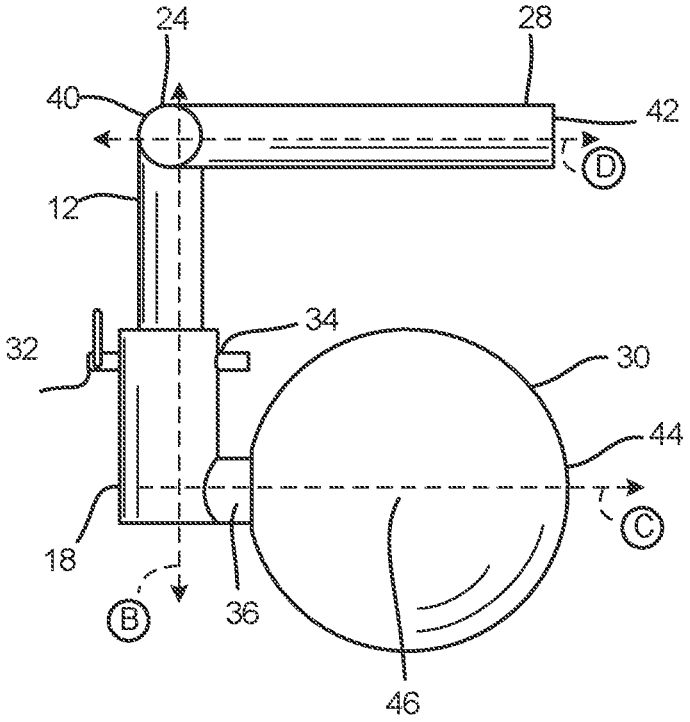
FIG. 1C is a side view of the embodiment of FIG. 1B.
Figure 1D:
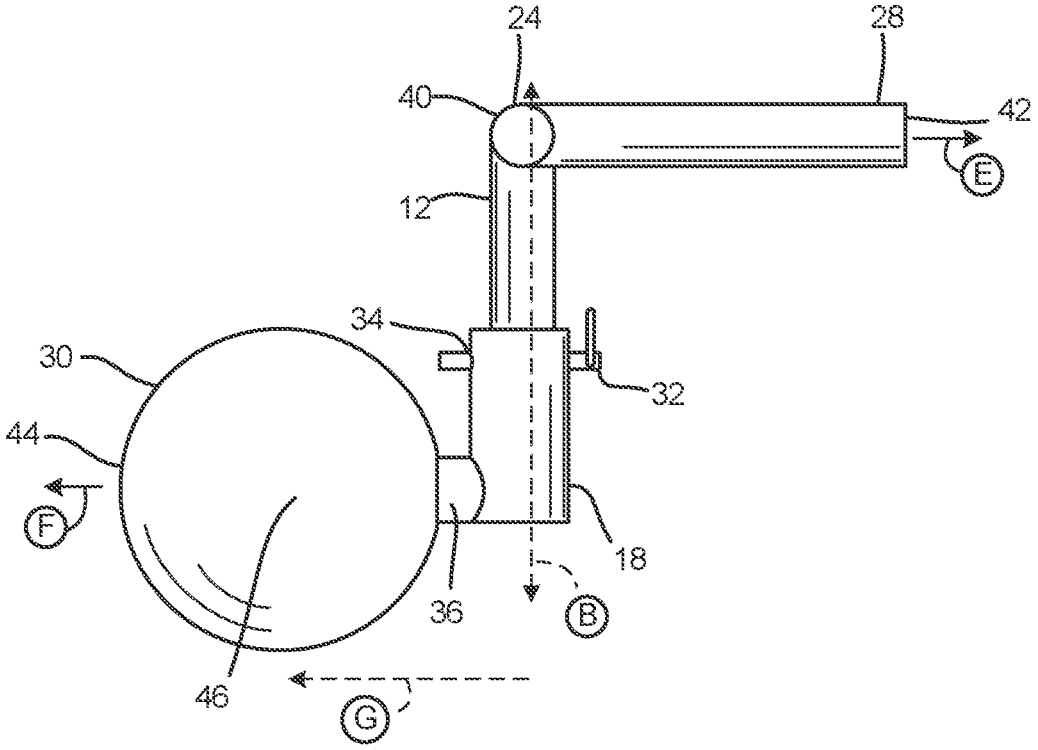
FIG. 1D is a side view of the embodiment of FIG. 1A.
Figure 1E:
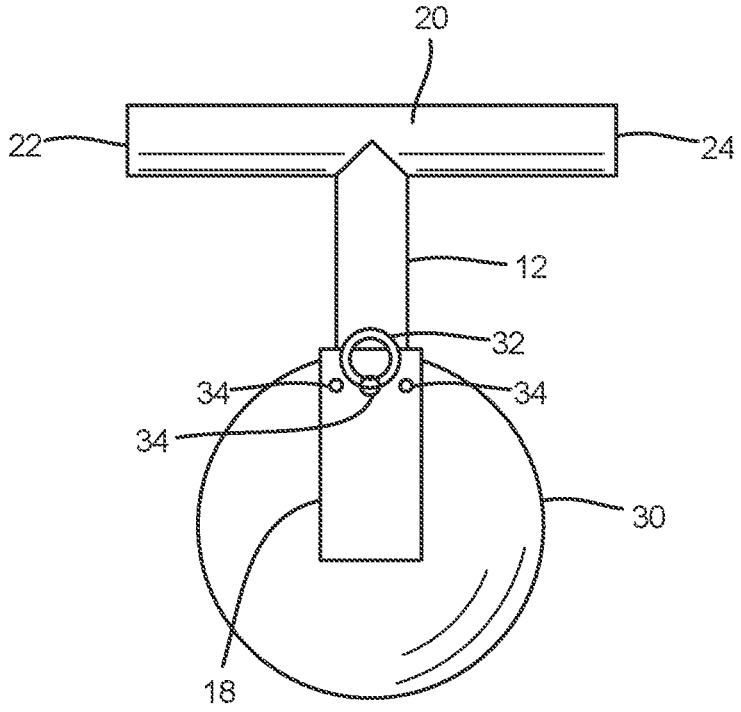
FIG. 1E is a front view of the embodiment of FIG. 1B.

FIG. 1C depicts a side-view of the bi-bell having the weight 30 oriented toward the handles, as in the embodiment of FIG. 1B. As is shown in both FIGS. 1C-D, the bi-bell 10 further comprises a linkage 36 disposed between the collar 18 and weight 30, so as to suspend the weight 30. In FIG. 1D, the weight has been rotated 180 degrees back. As shown in FIG. 1C, in this embodiment the central post 12 defines a post axis B, which is substantially perpendicular to the weight axis C and handle axis D, as defined by the first handle end 40 and second handle end 42. Other configurations are possible, and would be apparent to one of skill in the art. For example, for various implementations the angles defined by B-C and B-D can be acute or obtuse relative to the central post 12.

Figure 1F:
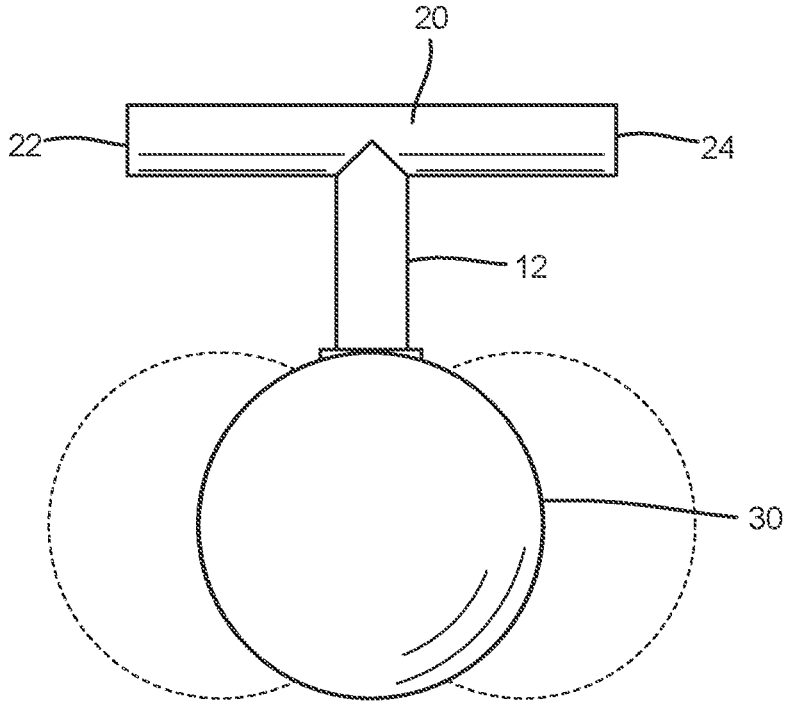
FIG. 1F is a front view of the embodiment of FIG. 1A.
Figure 1G:
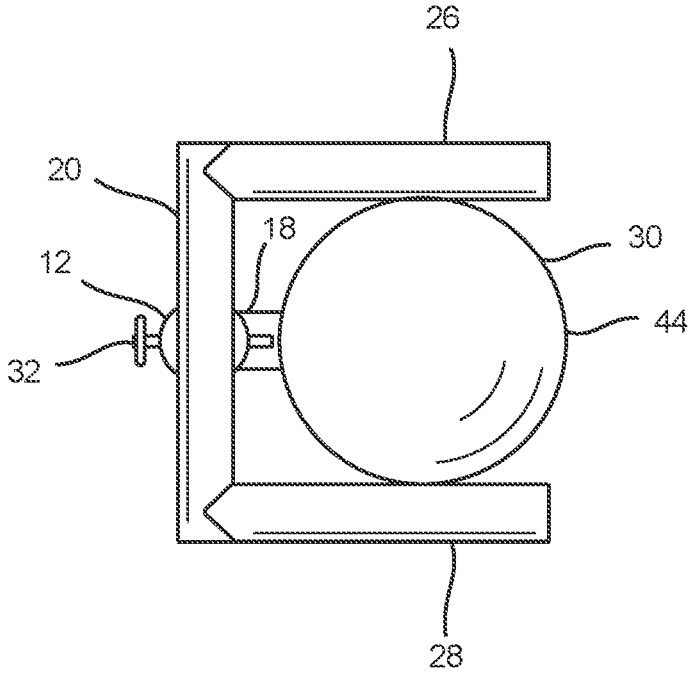
FIG. 1G is a top view of the embodiment of FIG. 1B.
Figure 1H:
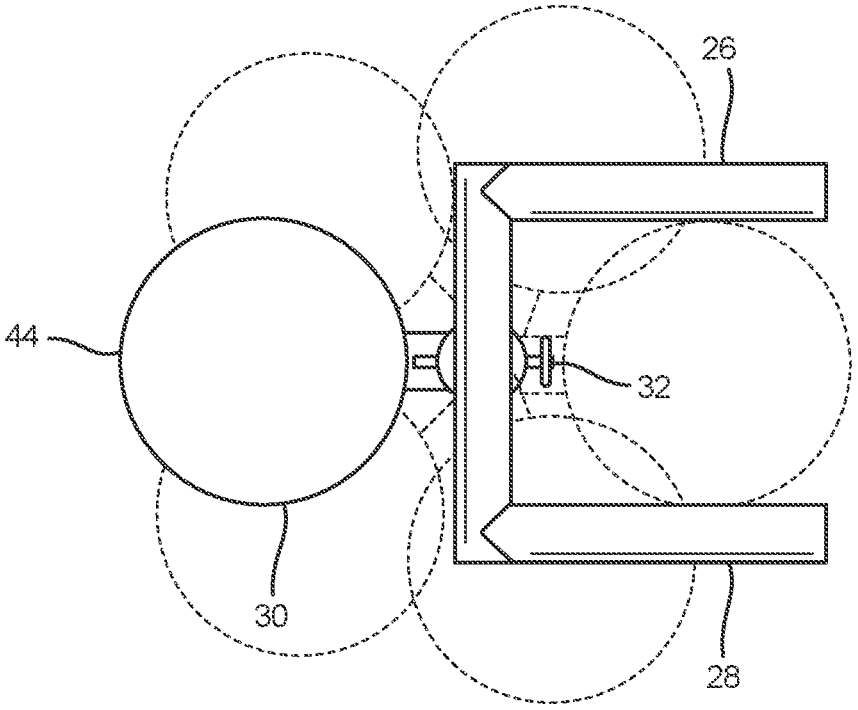
FIG. 1H is a top view of the embodiment of FIG. 1A.

Although the examples depicted above generally depict the weight being fixed generally in forward and back positions, in further embodiments additional openings may be provided through the collar to allow for further fixed positions, such as 45 degrees, 60 degrees, 90 degrees, 105 degrees, 120 degrees, 135 degrees or other angles in either direction from reference line C, as would be appreciated by one of skill in the art, and as shown in FIGS. 1F and 1H. These various configurations are discussed below in reference to FIGS. 3A-C as the fixed configuration.

As shown in FIG. 1C, in this embodiment the weight 30 comprises a distal terminus 44 and center of gravity 46. As shown in FIG. 1D, the linkage 36 suspends the center of gravity 46 at a consistent distance (shown at reference line G) from the central post 12 axis (B). As would be apparent to one of skill in the art, for certain applications this distance G can be varied by varying the length of the linkage 36. In various embodiments, in use, the bi-bell weight 30 is configured to be rotated freely about the central post 16 by way of the collar 18 such that the weight 30 rotates around the central post 12 relative to first handle 26 and second handle 28 (also referred to as the elongate members 25). As discussed below in relation to FIGS. 4A-4D, these rotating configurations allow for a variety of additional exercises to be performed by the user at low impact.

As shown in FIG. 1D, the rotation of the weight 30 causes the distal terminus 44 and center of gravity 46 to rotate away from the handles (shown at reference letters E and F, respectively). In exemplary embodiments, the collar fastener 32 is removed from the opening 34 to facilitate such movement/rotation.

FIGS. 1E-1H depict further views of the bi-bell 10. In use the bi-bell 10 can be used in a fixed or rotating configuration. In the fixed configuration position, as shown in FIGS. 1A-B and 1C-D, with the collar fastener 32 passed through the opening 34, the collar 18 and weight 30 will be prevented from rotating around the central post. In these fixed positions, the weight can be disposed in tor he same direction as the handles (FIG. 1G) opposite from the handles (as shown in FIG. 1H), depending on the exercise sought to be performed.

Figure 2A:
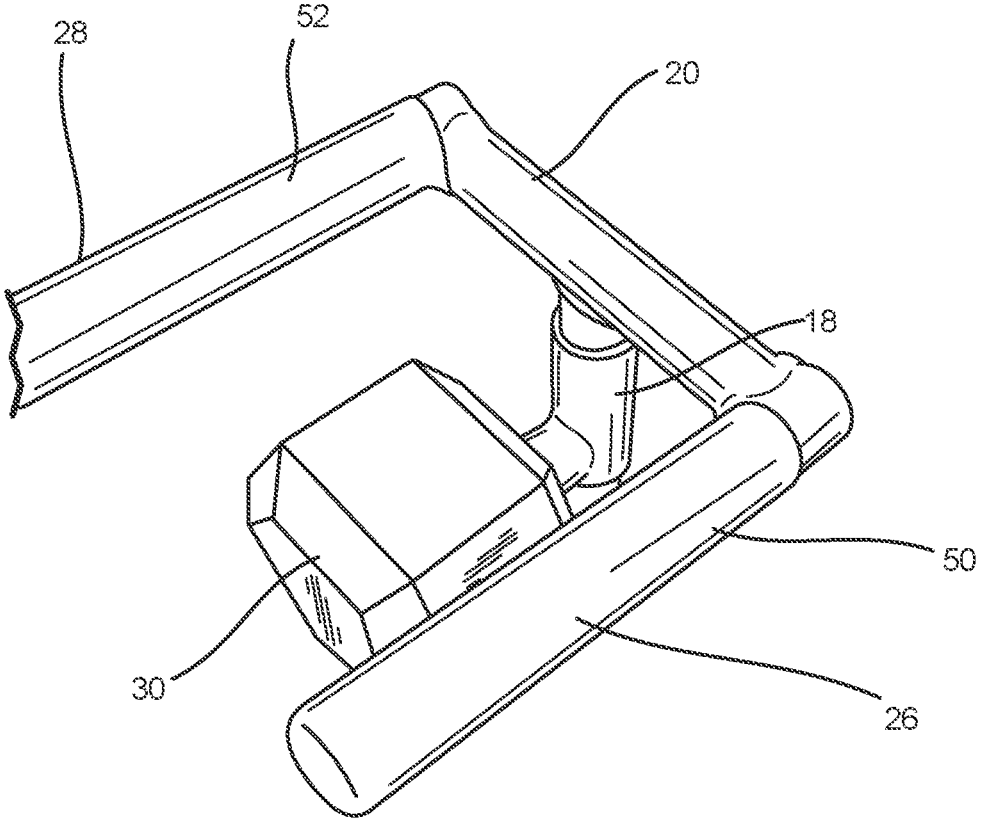
FIG. 2A is a rear perspective view of an alternate embodiment of the bi-bell.

In FIG. 2A, an alternate embodiment of the bi-bell 10 is shown, comprising a first handle grip 50 and second handle grip 52 fitted to the first handle 26 and second handle 28, respectively. In this embodiment, the weight 30 is a dumb bell. Other weights can be provided, as discussed in relation to FIGS. 2E-G.

Figure 2B:
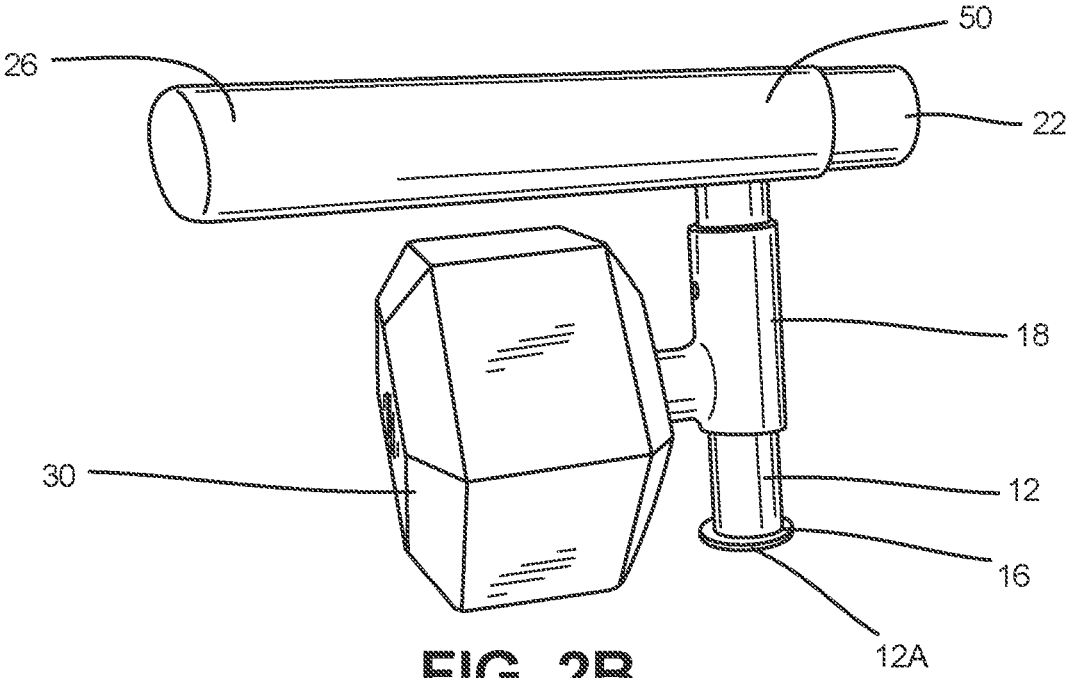
FIG. 2B is a side view of the embodiment of FIG. 2A.
Figure 2C:
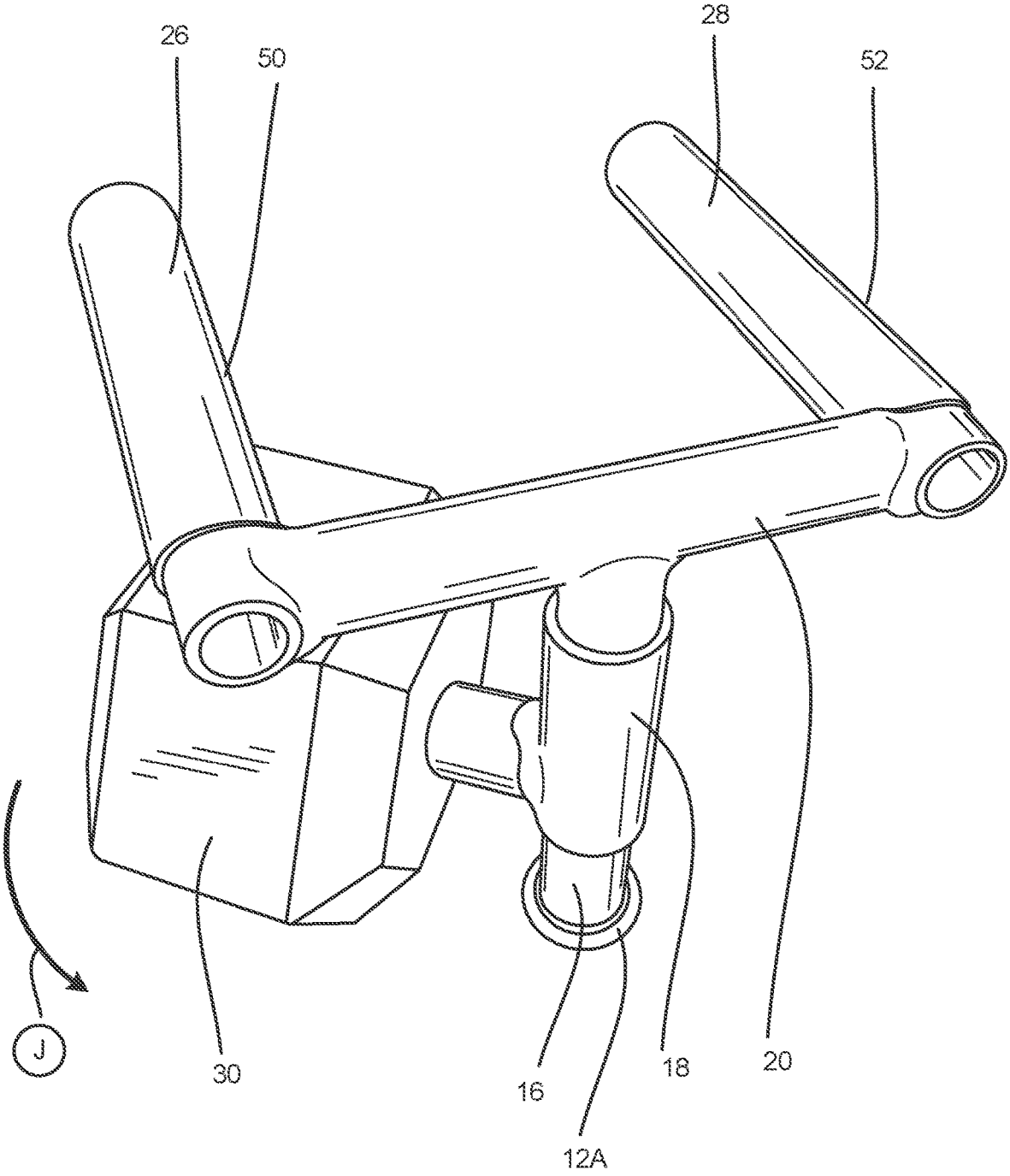
FIG. 2C is a front perspective view of the embodiment of FIG. 2A, with the weight in a free rotation position.
Figure 2D:
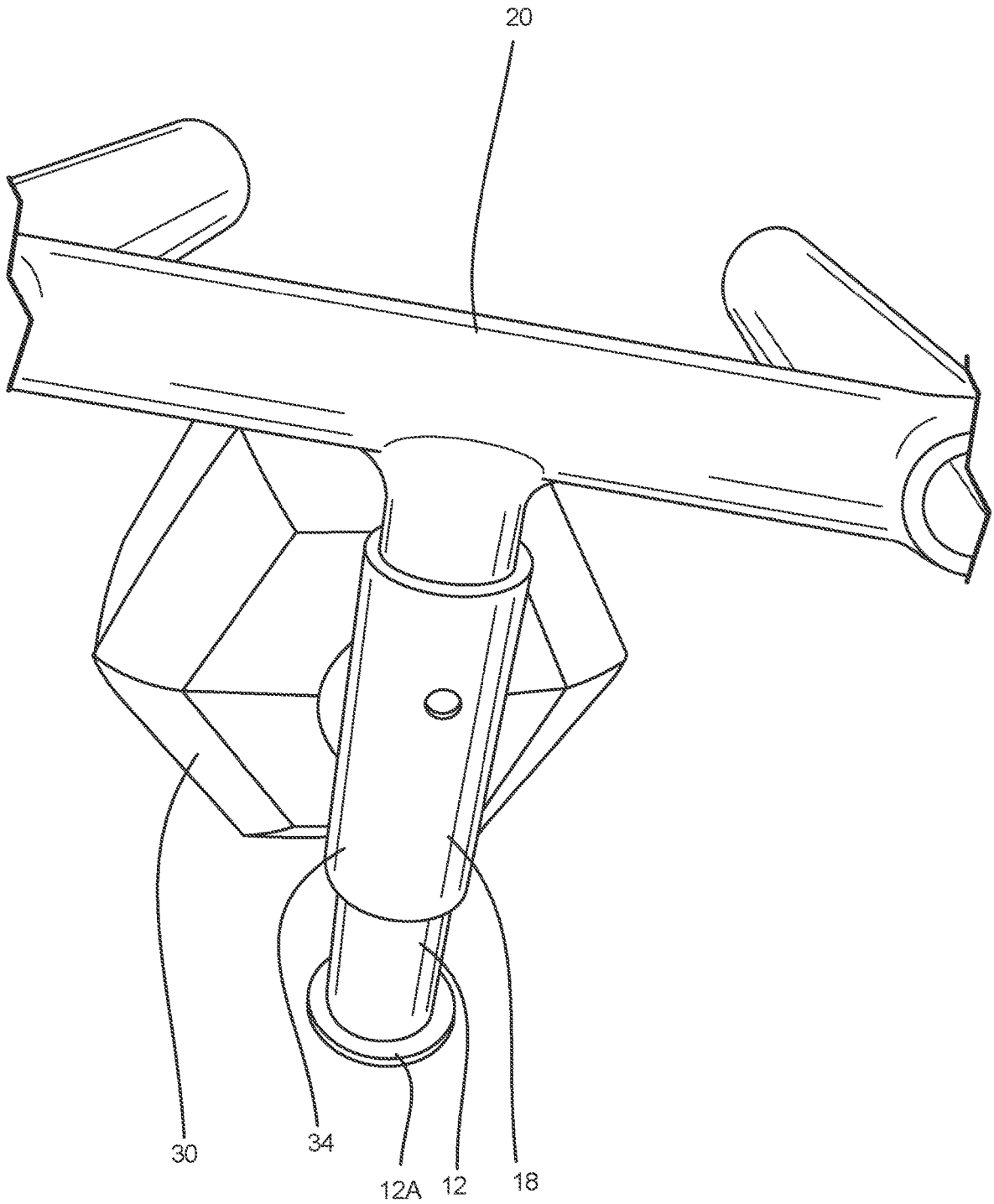
FIG. 2D is a further front view of the embodiment of FIG. 2C, featuring further weight rotation.

Further, as shown in FIG. 2B, the collar 18 is disposed around the central post 12 such that it is slideable relative to the central post 12, as designated by reference arrow H. In these embodiments, a collar stop flange 12A is disposed at the second post end 16, so as to prevent the collar 18 from disengaging with the central post 12. As shown in FIG. 2B, the collar stop flange 12A is disc-shaped having a diameter greater than the central post 12 fixedly attached to the second post end 16. In certain embodiments, the central post flange 12A is removable, such that the collar 18 may be removed from the central post 12. In certain embodiments, different weights 30 can be attached to several collars 18, so as to provide the user with various choices and options for various exercises well-known in the art. As would be apparent to one of skill in the art, other embodiments are possible. FIGS. 2C-D depict further views of these embodiments of the bi-bell 10. In these embodiments, the weight 30 has been freely rotated (reference arrow J) around the central post 12.

Figure 2E:
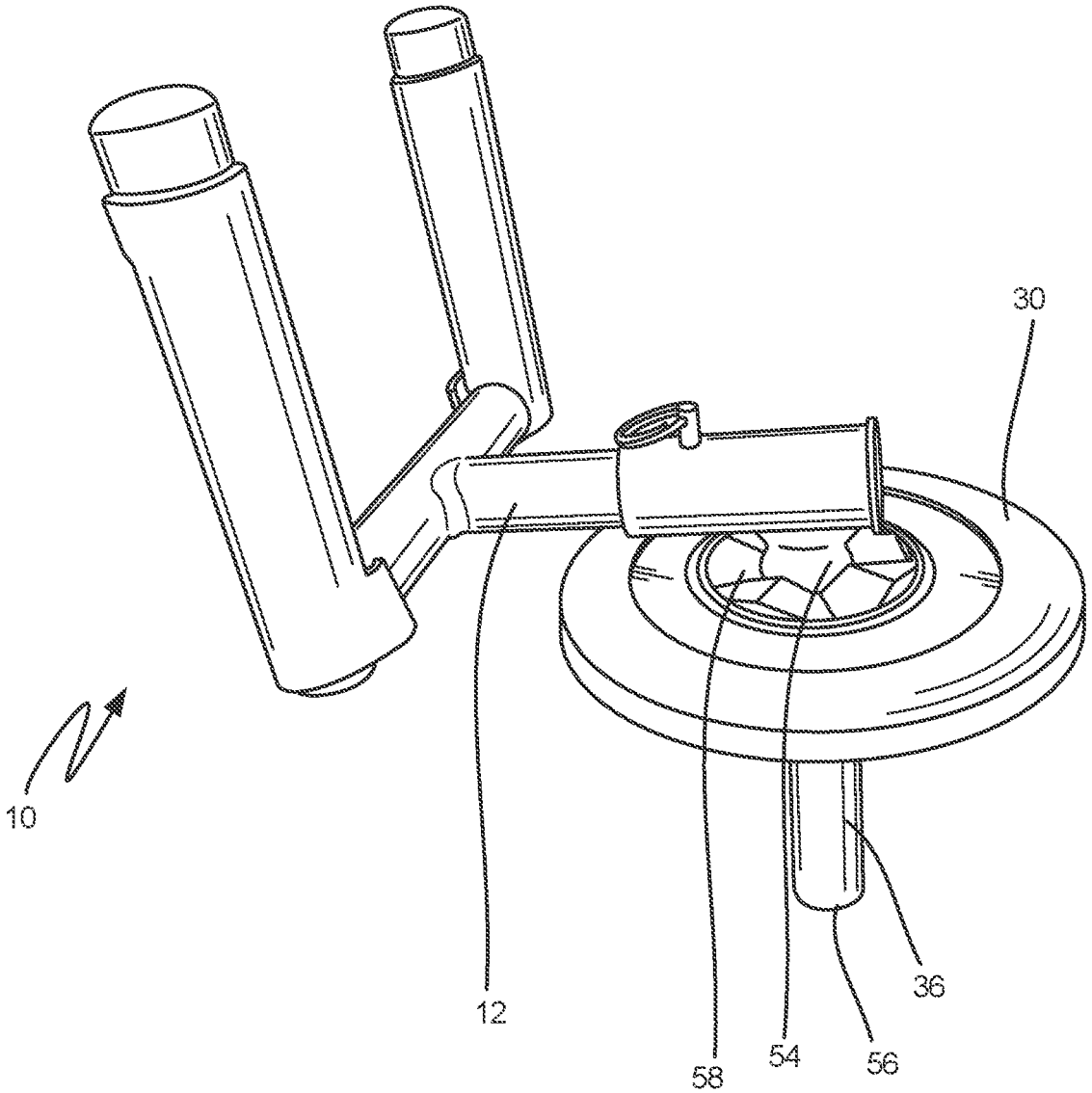
FIG. 2E is a perspective view of an alternate embodiment of the bi-bell adapted to accommodate a plate-style weight.
Figure 2F:
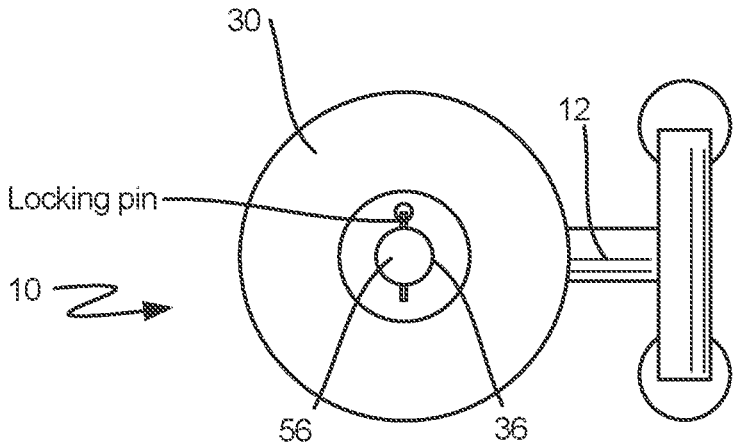
FIG. 2F is a rear view of the embodiment of FIG. 2E.
Figure 2G:
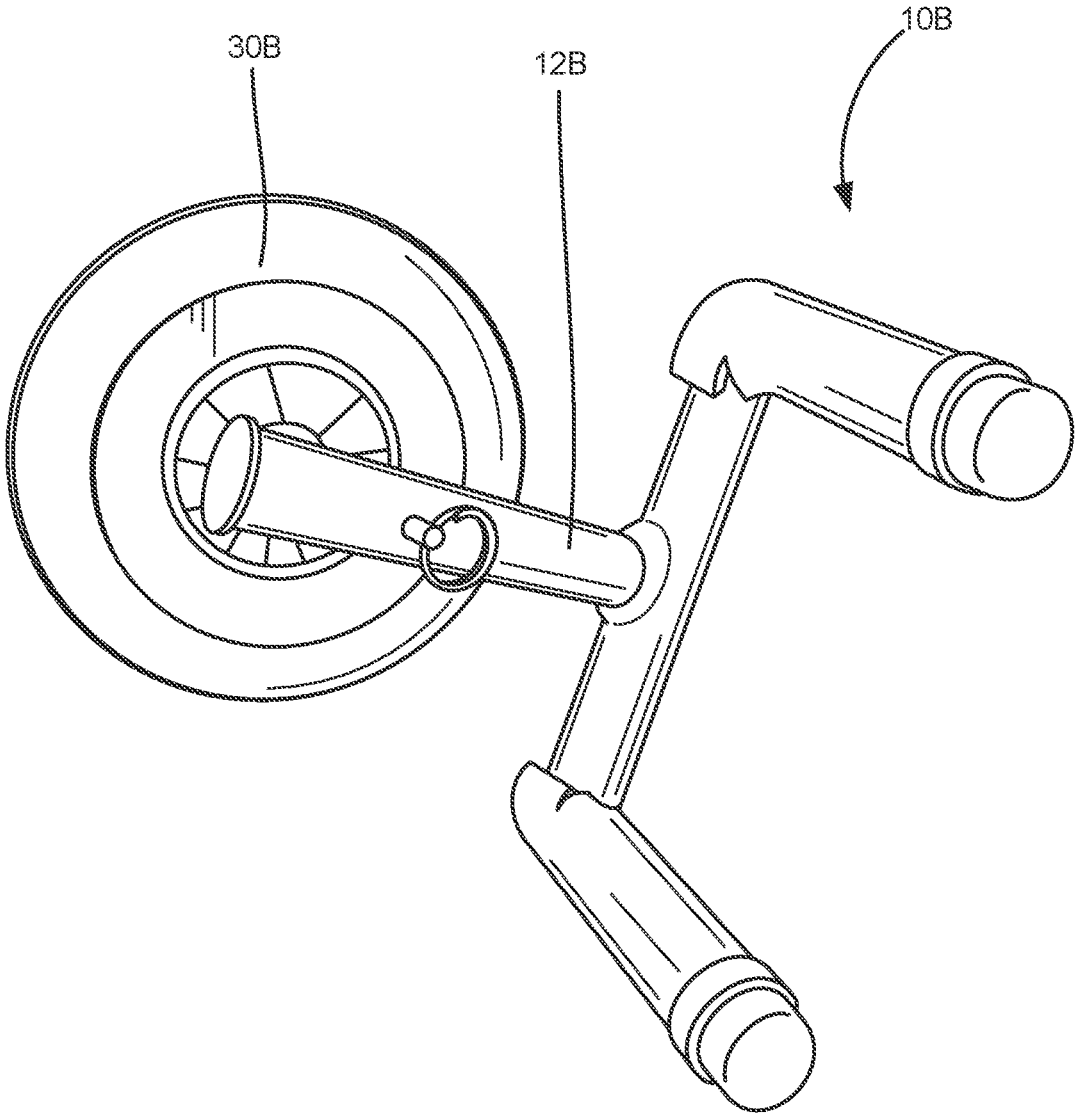
FIG. 2G is rear, lower perspective view of the embodiment of FIG. 2E.

FIGS. 2E-F depict an alternate embodiment of the bi-bell 10. In this embodiment, the linkage 36 is configured to accommodate at least one plate-style weight. The linkage 36 thereby comprises a first linkage end 54 and second linkage end 56, such that a weight 30 comprising an opening 58 can be fitted onto the linkage 36. In use, a user may thereby adjust the amount of weight 30 on the linkage 36 and therefore the bi-bell 10.

Continuing with FIGS. 2E-F, in these embodiments a linkage fastener 60 such as a lynchpin, clamp, quick-release spring-clip collar, tensioned mechanical stopper or combination of fasteners is provided, to secure the weight 30 in a fixed position, as would be apparent to one of skill in the art. The fastener 60 may further include a detent mechanism. The linkage fastener 60 may further include a washer.

According to various embodiments, the central post 12, first handle 26, second handle 28, and/or crossbar 20 (collectively, the elongate members 25) can have diameters that range from about 0.5 inches to about 2.5 inches. The various inner elongate members can be made of stainless steel, aluminum, plastic, or other suitable material with strength appropriate for bearing the weight 30, or any combination thereof.

Figure 3A:
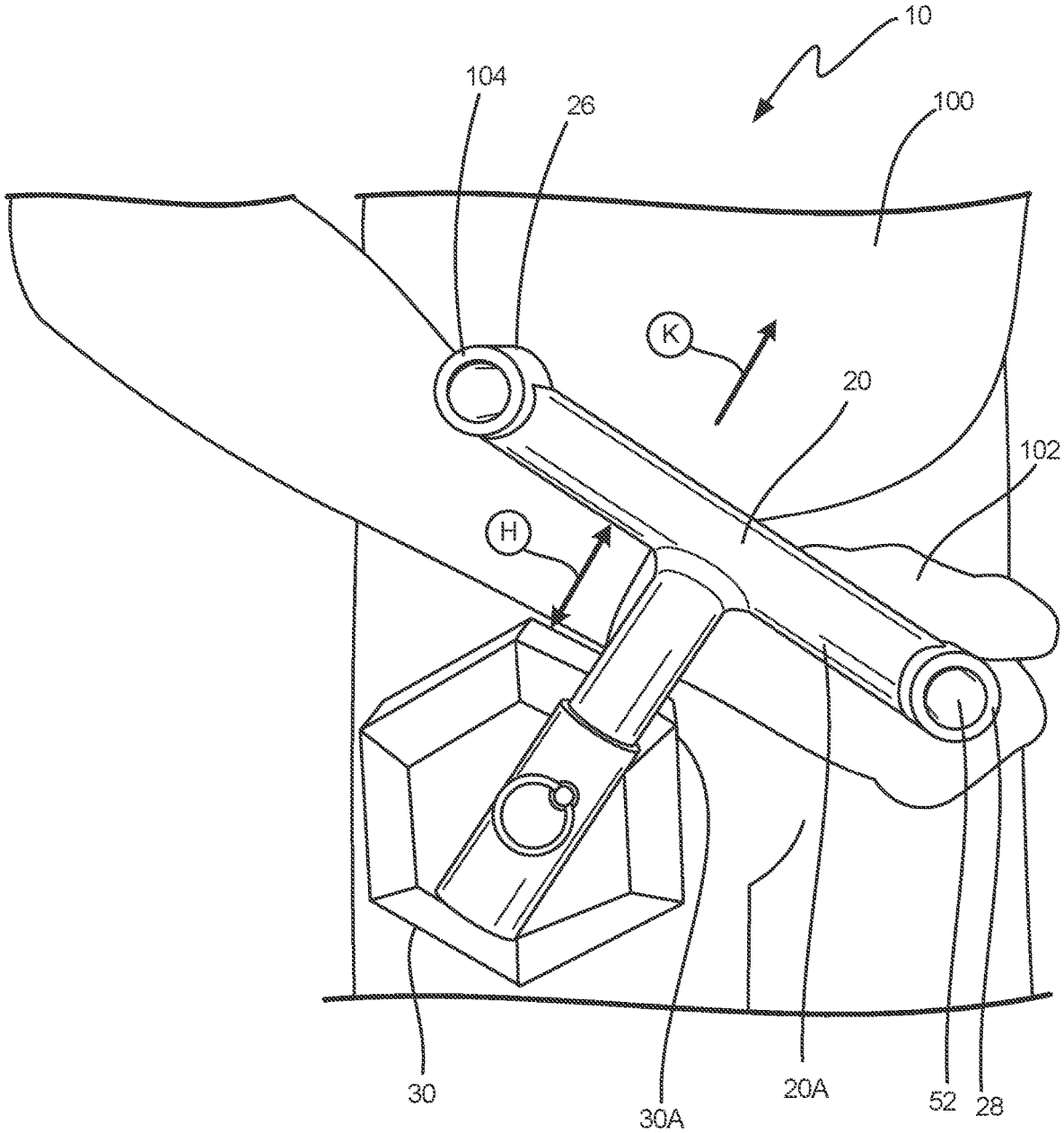
FIG. 3A is a front view of the embodiment of FIG. 2A in use, wherein the weight is in a fixed configuration oriented in the direction of the handles.
Figure 3B:
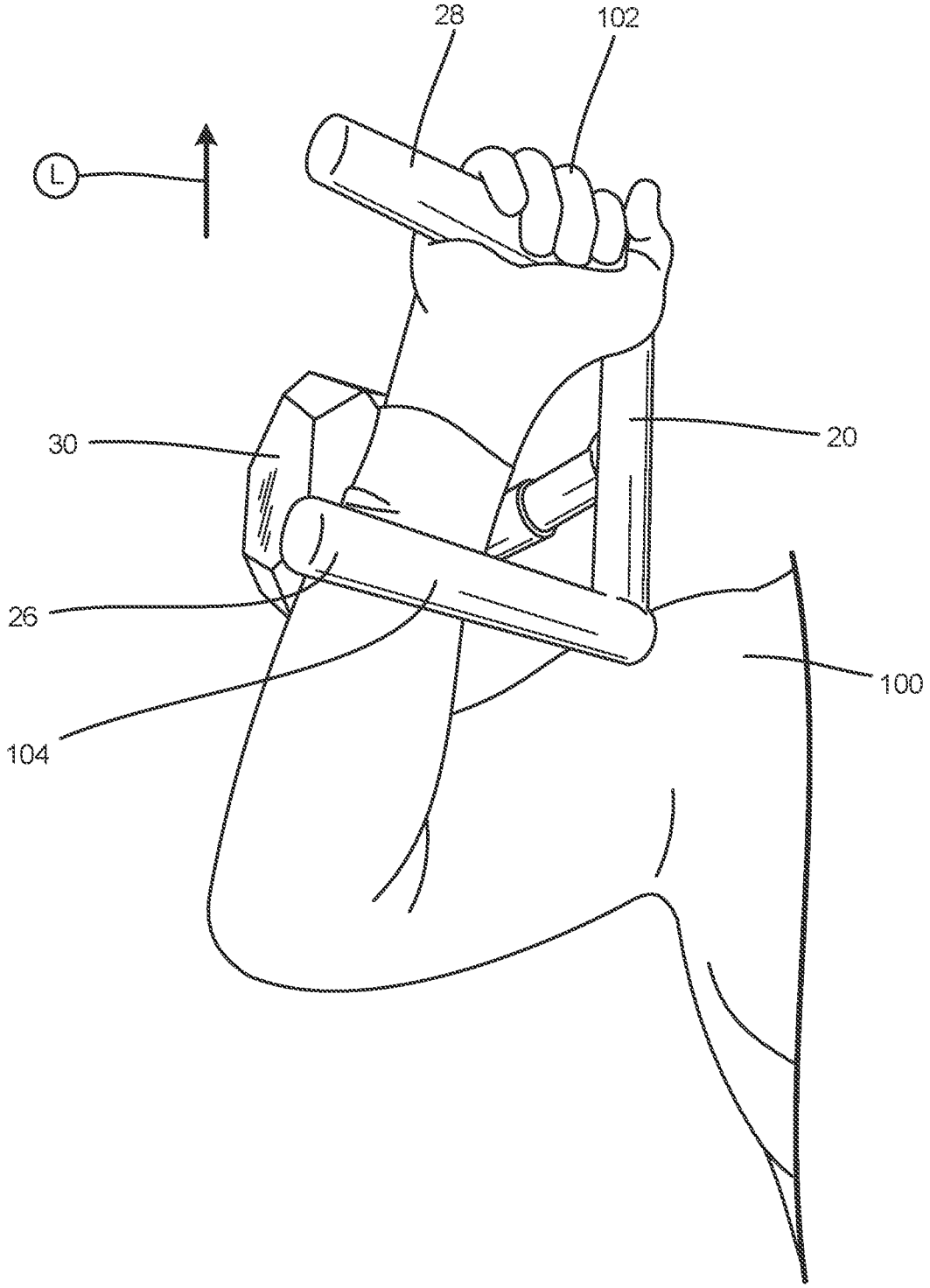
FIG. 3B is a low perspective view of the bi-bell embodiment of FIG. 3A in use in a press exercise.
Figure 3C:
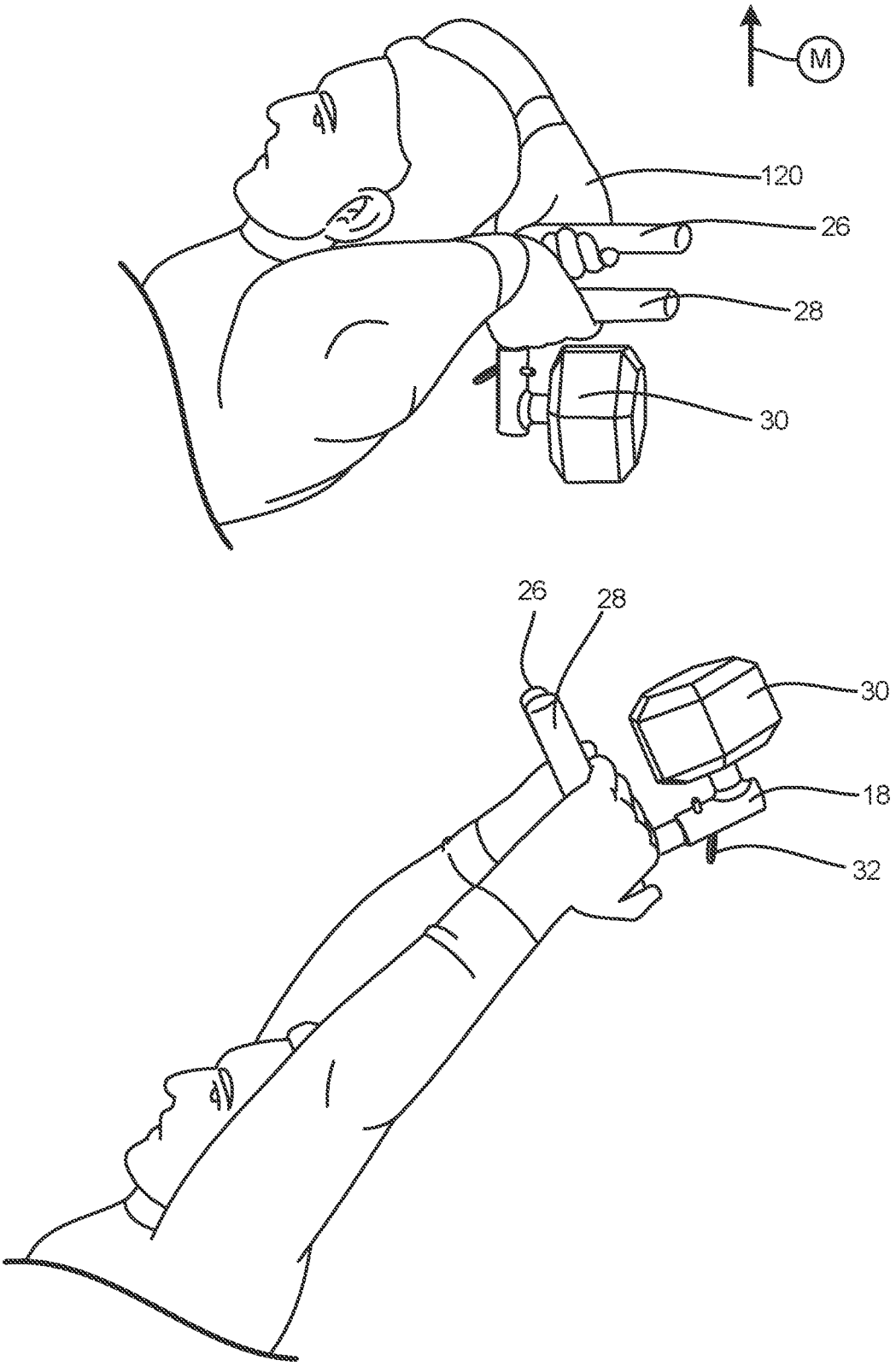
FIG. 3C is a side view the bi-bell of FIG. 3A in use in a French press style exercise.

In fixed use, and as shown in FIGS. 3A-C, a user 100 is able to grasp the bi-bell with either hand 102 by way of the first handle 26 and/or second handle 28. In these embodiments, the user 100 is able to then pass the bi-bell through a variety of movements, grasping the bi-bell 10 with each or both hands 102 to perform a variety of core, leg, arm and other exercises, as would be appreciated by one of skill in the art.

Figure 6A:
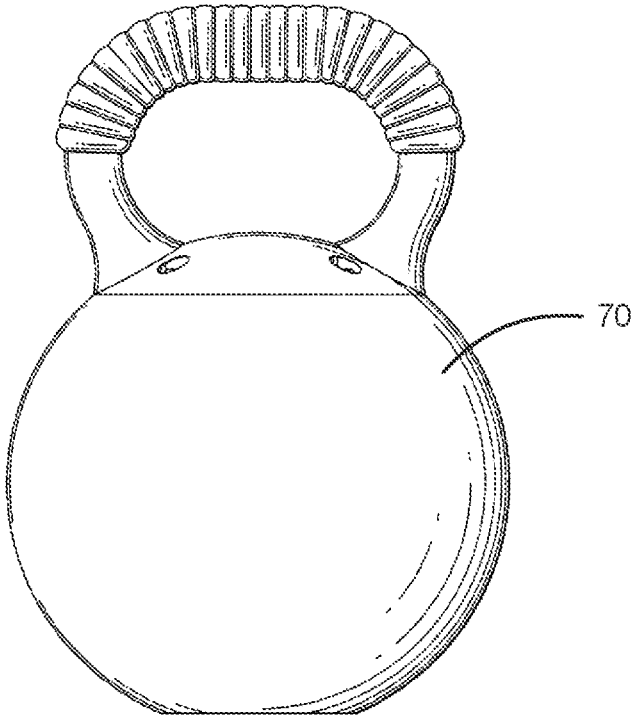
FIG. 6A (PRIOR ART)
FIG. 6A depicts a front view of a prior art kettle bell.
Figure 6B:
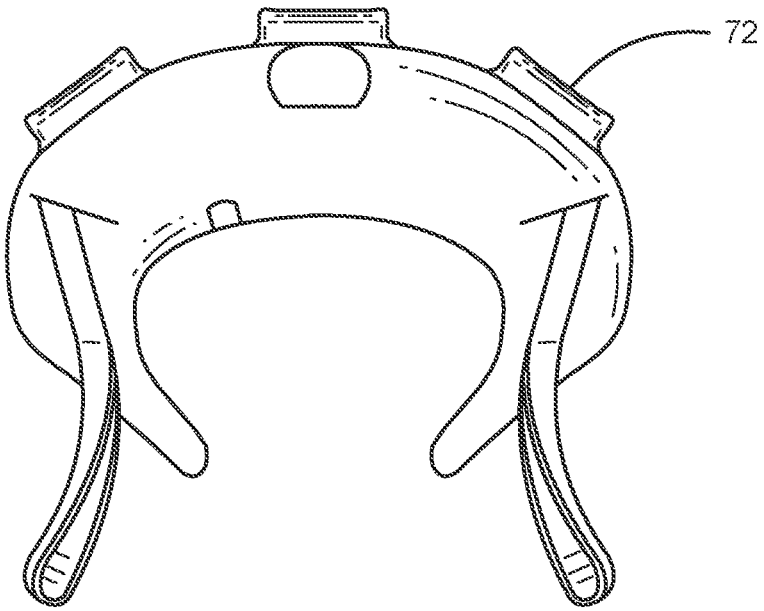
FIG. 6B (PRIOR ART)
FIG. 6B depicts a front view of a prior art Bulgarian sandbag.

Further, in these embodiments, the bi-bell provides a less-impactful alternative to traditional kettle bells and kettle bells (shown at 70 FIG. 6A), Bulgarian sandbags (shown at 72 in FIG. 6B), and the like. Because the user 100 is able to selectively rotate and lock the weight 30 relative to the crossbar 20, first handle 26 and second handle 28, the bi-bell presents several advantages over those prior art systems. For example, the user has more freedom to isolate specific muscles by positioning the weight relative to the elongate members 25. Further, when in either the fixed or rotating configuration, the bi-bell 10 can serve as a safer exercise device, as the weight may be shifted away from the user, or be configured so as to prevent undue impact.

Further, the various configurations can prevent the weight 30 from falling against the user, such as in press-style exercises (discussed below in relation to FIGS. 3B-C). Further, in exemplary embodiments, the rotating configuration can promote fluid movement of the weight 30 relative to the user, so as to provide maximum efficiency at the lowest impact, and to target and isolate muscle groups rather than joints and tendons. This can increase the user's workout efficiency and prevent injury.

As is shown in FIG. 3A, in these embodiments the weight 30 is disposed at a sufficient distance from the crossbar 20 (shown by reference arrow H) that the user's wrist 106 can pass through the opening between the upper portion of the weight 30A and the adjacent plane defined by the first handle 26 and second handle 28 (designated by the crossbar's lower portion 20A). As shown in FIG. 3A, when the use is grasping a handle, such as the second handle 28, the user is able to rest the first handle 26 against the forearm 104 so as to brace and further support the bi-bell 10. This improves the feel and safety of the exercise.

Further, in certain embodiments, this can convey a mechanical advantage, as would be apparent to one of skill in the art. The bi-bell 10 can accordingly be used in curl exercises (designated by reference arrow K) as would be apparent to one of skill in the art. As shown in FIGS. 3B-C, the bi-bell 10 is capable of use in further traditional exercises, such as the incline French press, designated by reference arrow L. As would be apparent to one of skill in the art, in each of these exercises, the bi-bell 10 can be used with the collar fastener 32 in place.

FIGS. 4A-4D depict the use of the bi-bell 10 in the free-rotating configuration. Importantly, in these embodiments, the weight 30 need not always rotate fully during the performance of any individual exercise. Rather, in many embodiments the weight 30 will swing or sway in response to the exercise motion and with respect to centrifugal and/or centripetal forces.

Figure 4A:
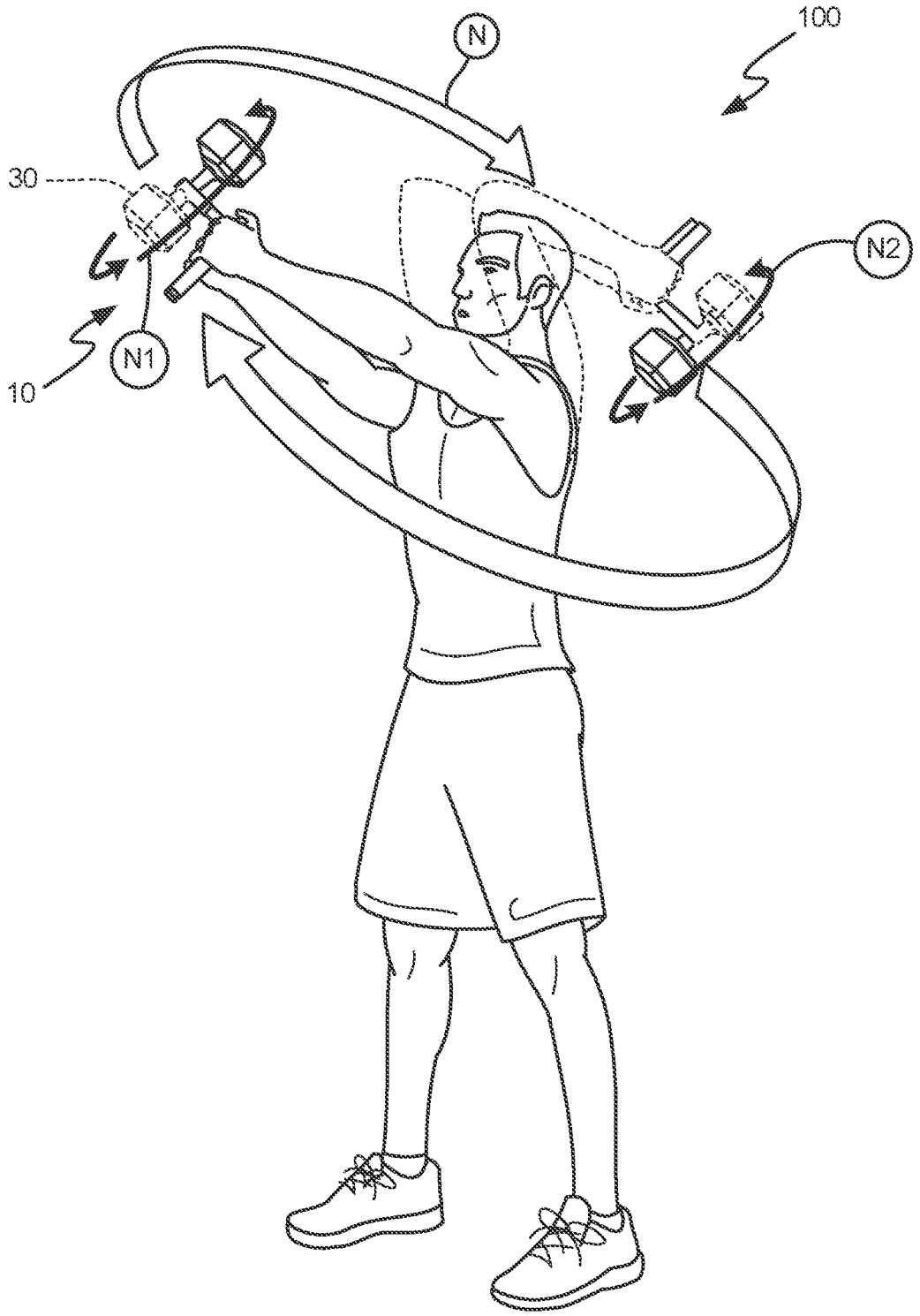
FIG. 4A is a three-quarters view of an embodiment of the bi-bell in a rotating configuration in use in a hammer-throw style exercise, such that the weight is capable of free rotation around the central post.

For example, as shown in FIG. 4A, the user 100 is rotating the bi-bell 10 around reference arrow N in a fashion similar to a hammer throw. In this implementation, the user 100 is able to start in a first, forward-facing position (as shown by reference number 10), and the weight 30 is free to rotate about the central post 12 (designated by N1 and N2) while the user 100 moves the bi-bell through the exercise. In these implementations, the weight may rotate (N1, N2) at any point along the N are due to momentum, centrifugal, centripetal, gravitational or other forces. In these embodiments, the user 100 is thus capable of smooth, weighted resistance training exercises because the weight 30 moves in response to the movement so as to shift the relative load between the user's 100 hands 102. This results in lessened impact on the user's joints and musculature, as would be apparent to one of skill in the art.

Figures 1, 4B:
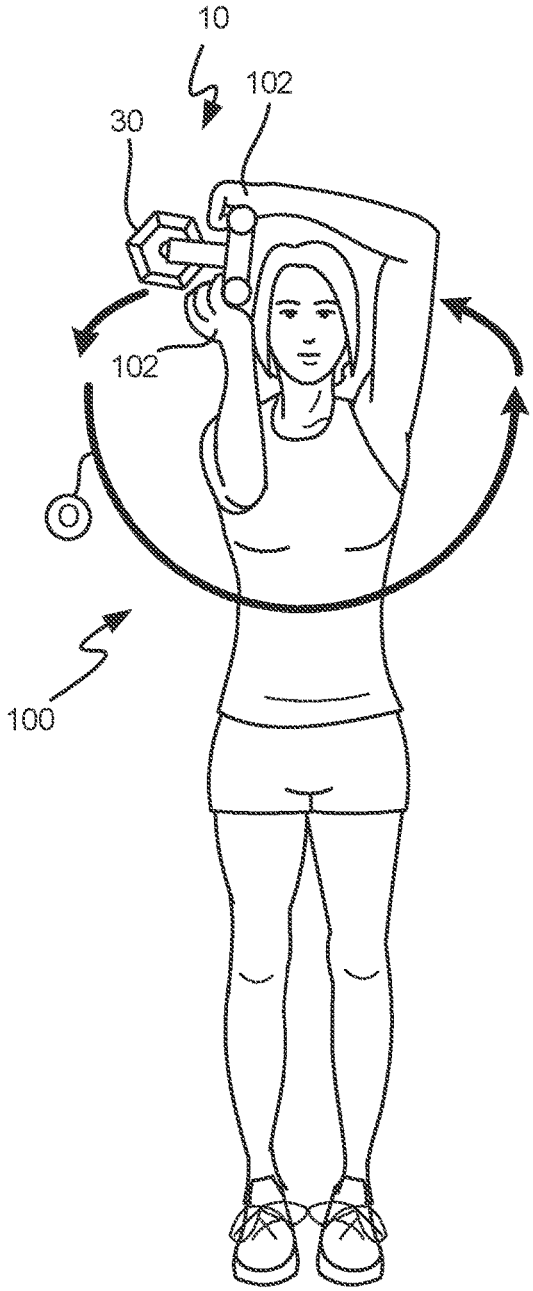
FIG. 4B-1 depicts a front view of a user using a bi-bell in the rotation configuration being used in an alternate rotating exercise, according to an exemplary embodiment.
Figures 2, 4B:
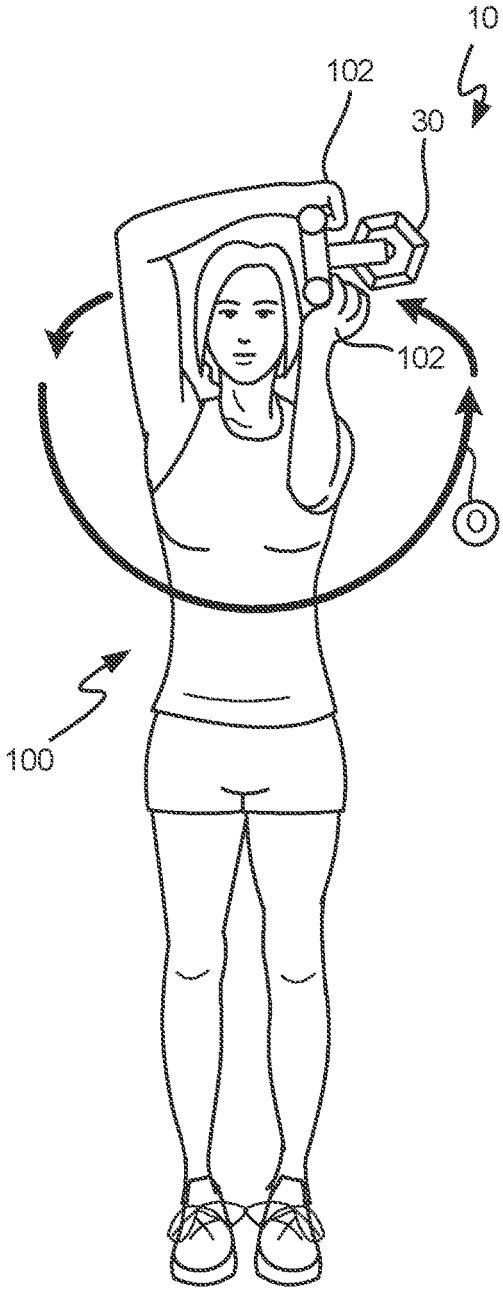

As shown in FIG. 4B, the user 100 may use the bi-bell in any number of rotational or other exercises known in the art, including those typically performed with prior art kettle bells (shown at 70 FIG. 5A), Bulgarian sandbags (shown at 72 in FIG. 5B), or other weights. As shown in FIGS. 4B-1 and 4B-2, the user 100 is able to pass the bi-bell 10 around the user's 100 body, such that the weight 30 is consistently oriented away from the user's body 100. Again, a fluid and otherwise smooth and safe motion is achieved by the shifting of the weight 30 in response to the user's movements.

Figures 1, 2, 3, 4C:
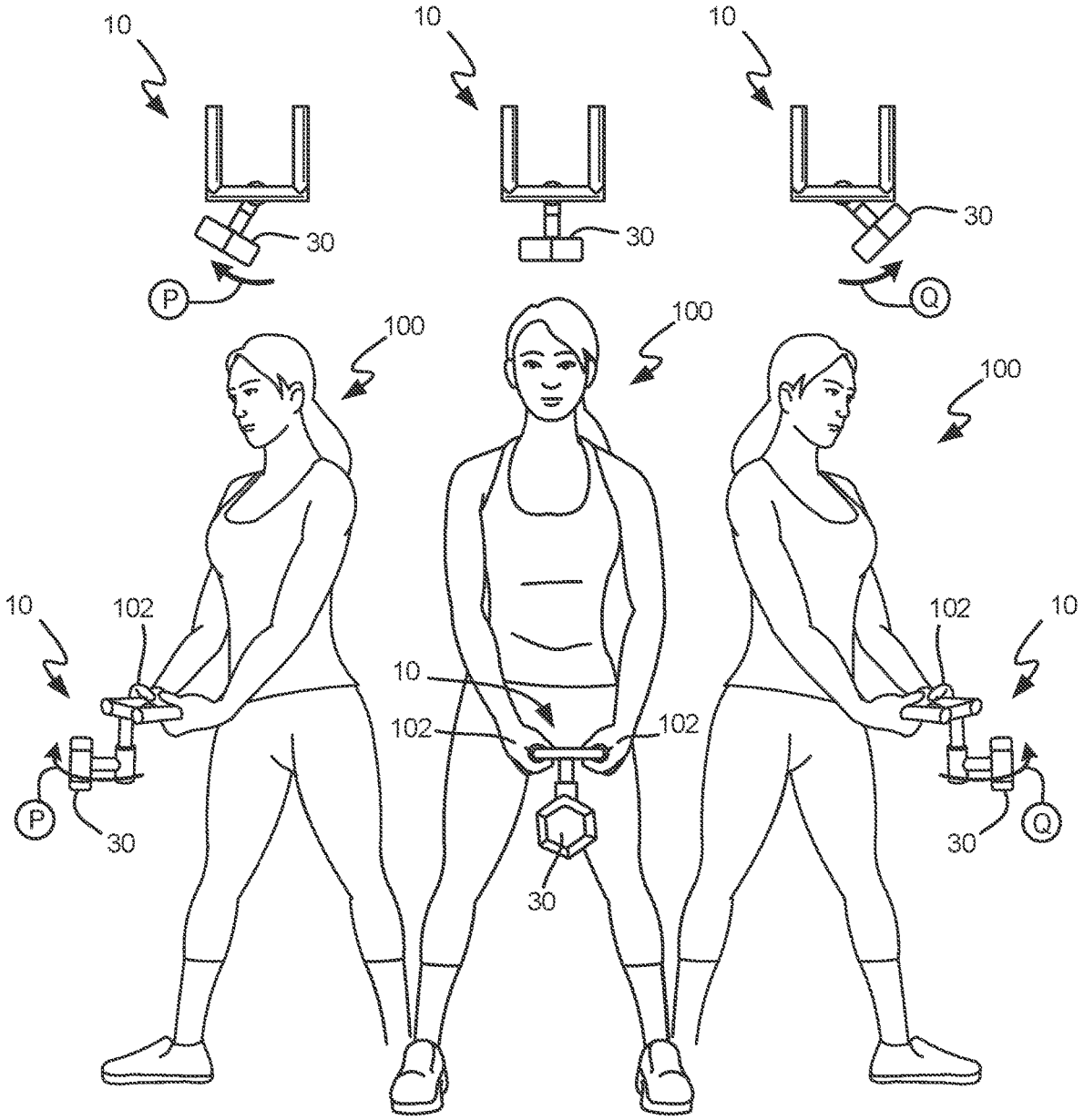

As shown in FIGS. 4C-1 through 4C-3, the weight 30 is able to sway in either direction (designated by reference letters P and Q in FIG. 4C-1 or 4C-3) in response to the user's 100 movements. As shown in FIG. 4C, the user 100 is able to begin in a first position shown in 4C-2. In response to the user's urging of the bi-bell 10 in either direction (4C-1 or 4C-3), the weight 30 freely rotates. Importantly, in some embodiments, and depending on the rhythm of the user's movements, the weight may "lag" or otherwise trail the movement of the elongate members 25 as would be apparent to one of skill in the art. Importantly, the movement of the weight is controlled by any of the aforementioned forces, as controlled by the user 100.

Figure 4D:
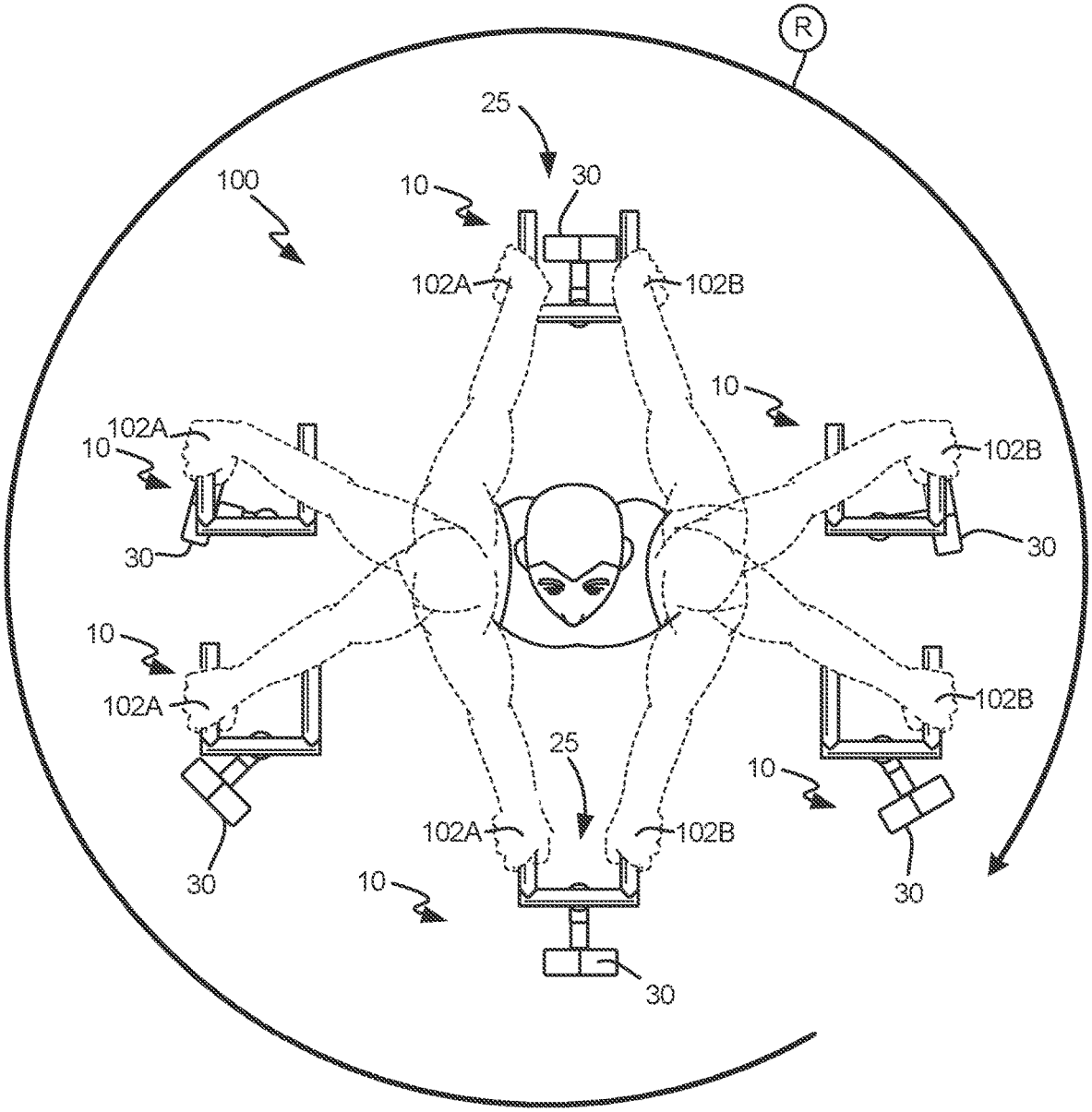
FIG. 4D depicts an overview of the bi-bell in use in the rotating configuration, according to an exemplary embodiment.

As shown in FIG. 4D, the user 100 is able to rotate the bi-bell 10 around the user's entire body (reference letter R). In this embodiment, the user 100 is able to shift the bi-bell 10 between a first hand 102A and second hand 102B, so as to maintain the orientation of the elongate members 25 while the weight 30 is able to swing freely in an 360 rotation relative to the elongate members 25. As would be apparent to one of skill in the art, this motion results in a smooth, low-impact exercise.

Figure 5A:
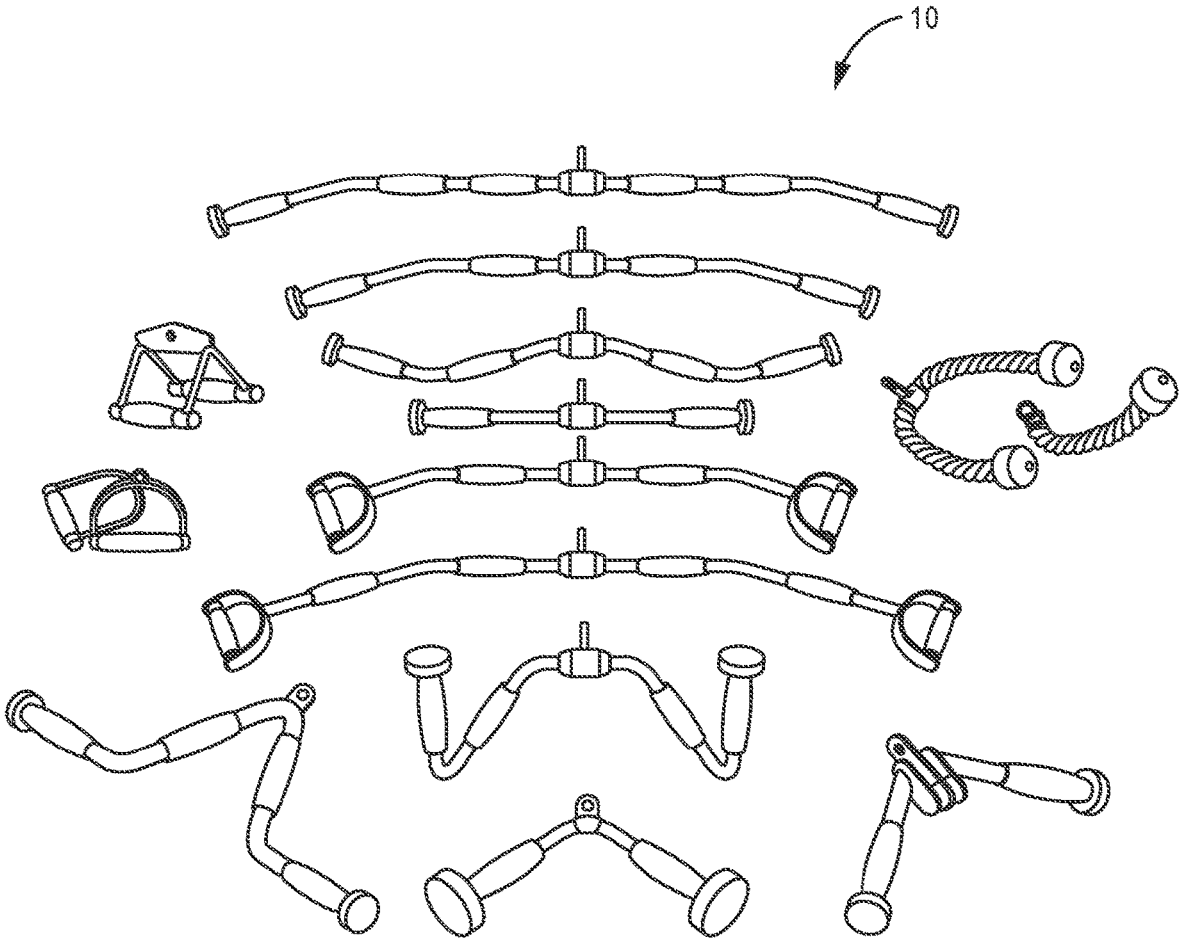
FIG. 5A (PRIOR ART)
FIG. 5A is an overhead view of a variety of handle types.

As shown in FIG. 5A, in various implementations of the system 10, a wide variety of handles or other gripping apparatus can be employed, as would be understood by the skilled artisan. For example, in certain implementations a straight bar, curl bar, lat bar, tricep bar, D-handle, seated row double D-handle or other known handle can be used, as would be understood.

Exemplary implementations of the bi-bell 10 feature a quick-release mechanism to allow the rapid change of weights on the device. In certain of these implementations, a quick release coupling 200 is provided that is a push button coupling. As would be apparent to one of skill in the art, alternate quick-release coupling 200 configurations are possible, such as "pull" designs and the like as would be understood by one of skill in the art. Certain non-limiting examples would include (but should not be limited too): push, pull or removable pin release systems, lever and locking channel, spring pin or wedge locking systems, fixed or removable clamping locking collar, threaded retaining nut with corresponding threaded shaft, set screw secure retainer. Pop pins and the like can be utilized as well, as would be understood.

Figure 5B:
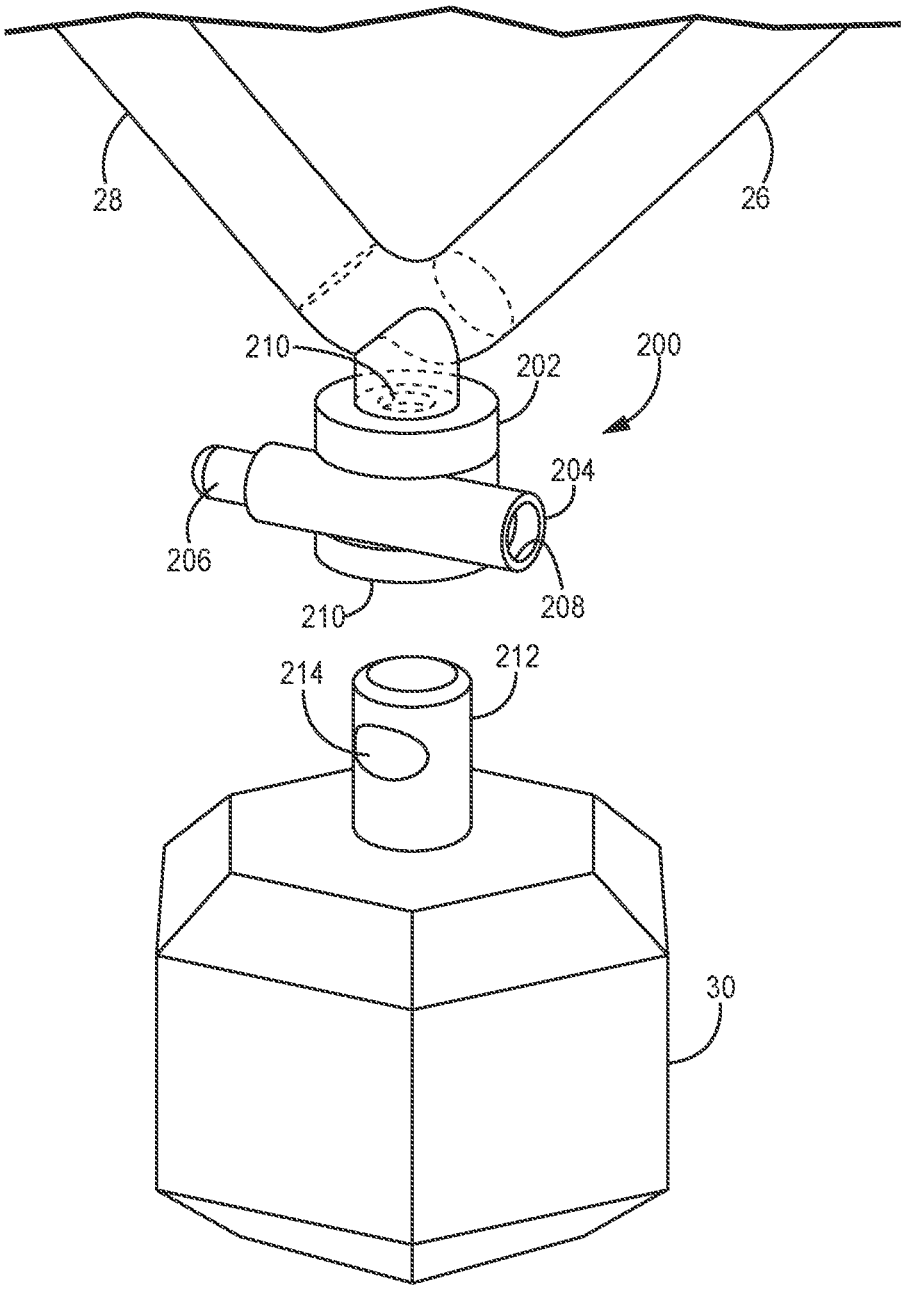
FIG. 5B depicts a close-up exploded perspective view of the bi-bell having a quick-release mechanism, according to one implementation.
Figure 5C:
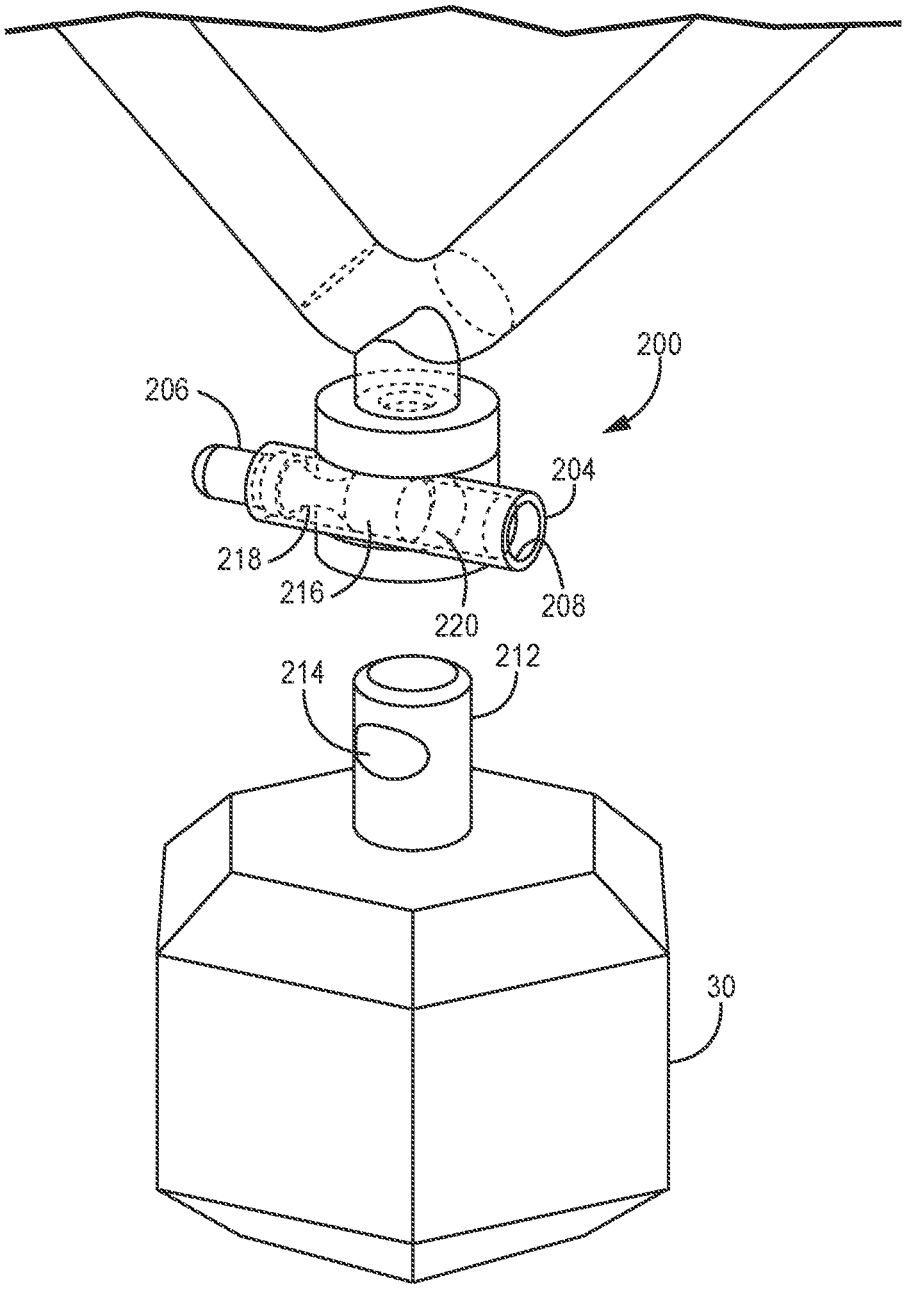
FIG. 5C is a further, transparent view of the implementation of FIG. 5B.
Figure 5D:
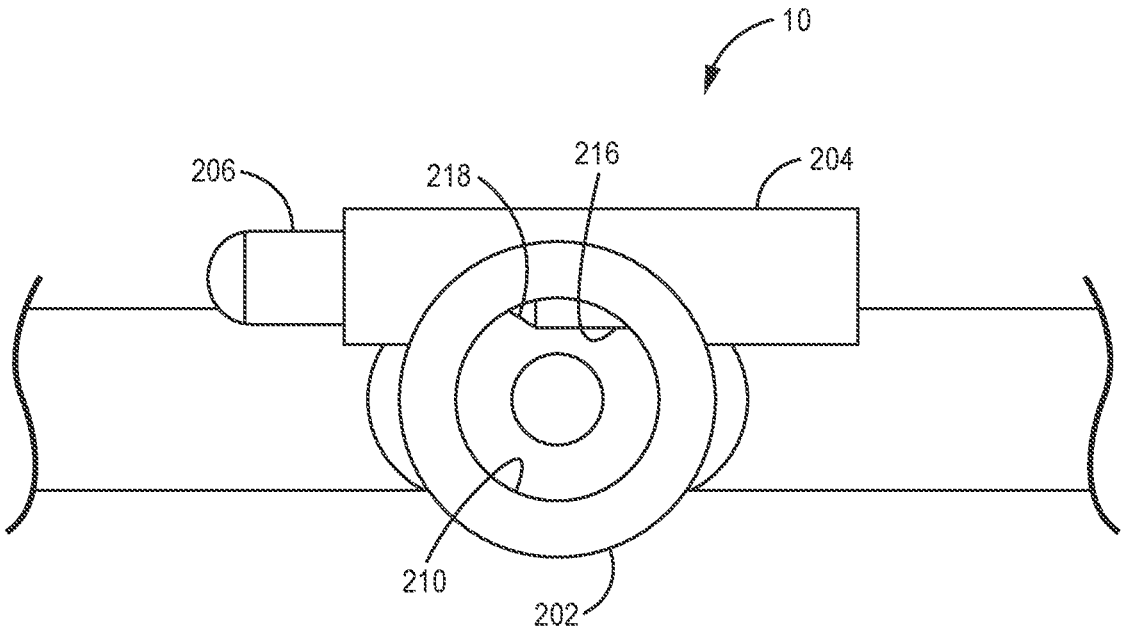
FIG. 5D is a top view of certain components of the implementation of FIGS. 5B-C.

In certain implementations of the bi-bell 10, and as shown in the implementations of FIG. 5B, FIG. 5C and FIG. 5D, a push button release system comprising a coupling 200 is provided. The push button release allows for safe, easy and quick transitions for different sizes of weight 30 "bell" and bars.

In the implementations of FIG. 5B, FIG. 5C and FIG. 5D, the push button quick release coupling 200 has a mating cylinder 202 with an push button shaft 204 perpendicularly disposed thereto, the elongate pin shaft having a elongate push button pin 206 disposed in a push button lumen 208 defined therein.

In these implementations, the mating cylinder 202 also defines a mating lumen 210 constructed and arranged so that a mating projection 212 from the weight 30 can be inserted therein and be secured by the push button shaft 204 via a mating channel 214 defined in the mating projection, as would be understood by one of skill in the art. As would be apparent, various structural variations are of course contemplated.

Continuing with the implementations of FIG. 5B, FIG. 5C and FIG. 5D, the push button pin 206 is an elongate member comprising a locking body 216 and a recess 218. In use, as would be apparent to the skilled artisan, the mating projection 212 of the weight can be quickly inserted into the mating lumen 210 of the mating cylinder 202 while the button pin pin 206 recess 218 is aligned with the mating projection.

In use, after insertion, according to these embodiments, the mating projection 212—and correspondingly, the weight 30—can be secured in place by urging the mating pin such that the locking body 216 is in secured communication with the mating channel 214. As would be readily apparent, many implementations are possible.

Figure 5E:
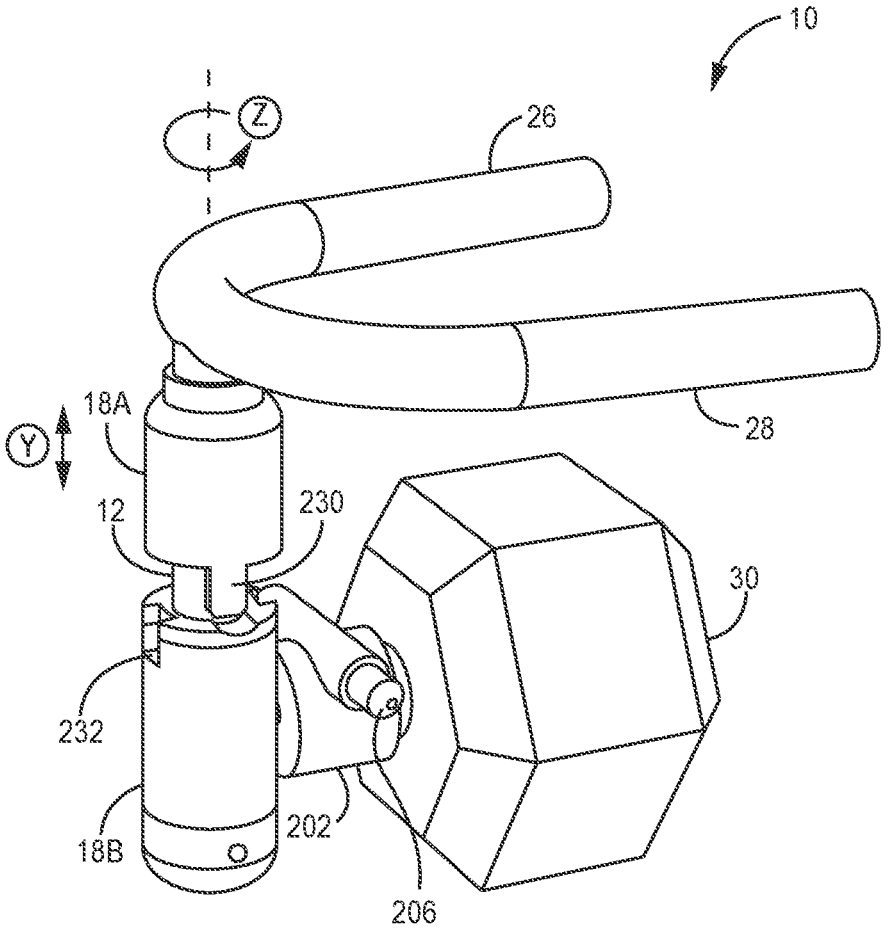
FIG. 5E is a perspective view of another implementation of the bi-bell, having a rotating collar.
Figures 1, 5E:
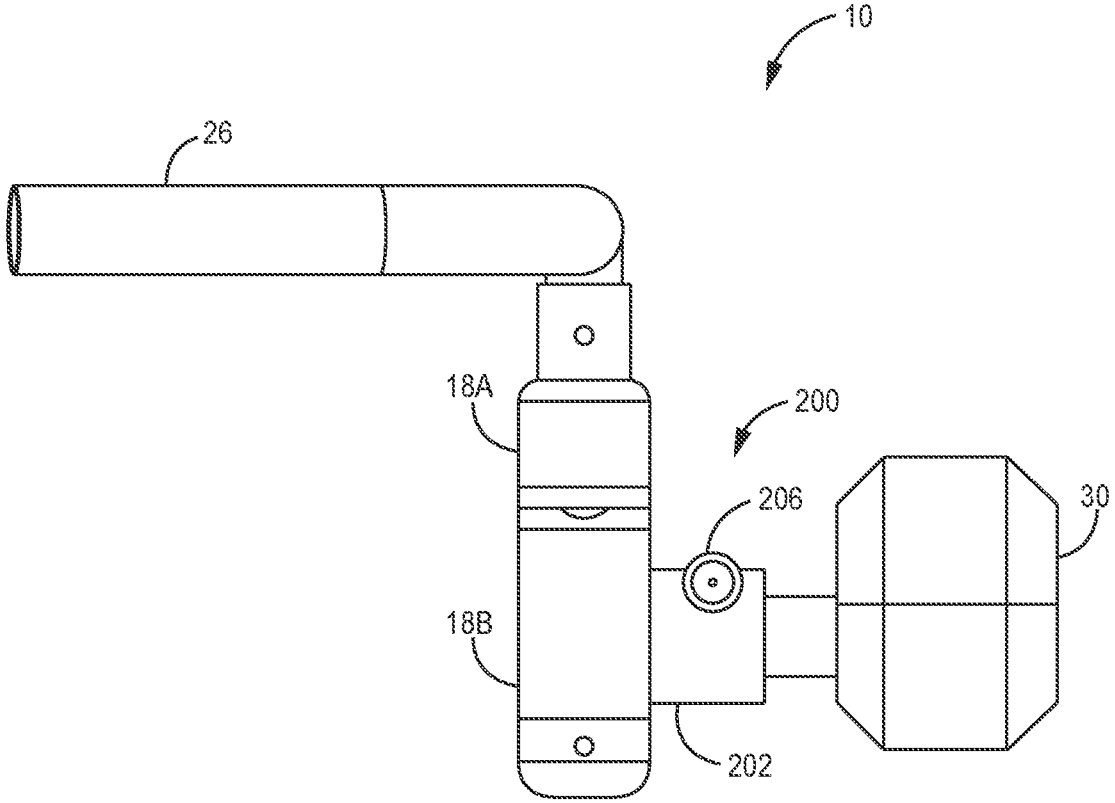

As is shown in the implementation of FIG. 5E, various implementations of the bi-bell 10 have a rotating locking elongate cylindrical collar 18 or rotating pivot collar 18. In these implementations, the cylindrical collar 18 comprises upper 18A and lower 18B portions that can be urged away from one another (as shown by reference arrow Y) such that the handles 26, 28 can be rotated relative to the weight 30 (as shown by reference arrow Z) and re-locked into an alternate orientation, such as 180 degrees away from the weight 30, as is shown in FIG. 5E-1.

It is understood that in these implementations, the upper 18A and lower 18B portions of the collar 18 comprise one or more locking tabs 230 and corresponding locking channels 232 so as to enable a variety of locked positions. It is further understood that springs or other tension devices can be used within the body of the collar 18 central post 12 or elsewhere within the bi-bell 10 to urge the collar portions 18A, 18B together (opposite reference arrow Y).

It is further appreciated that these implementations may also include the push button 206 system described above, such that various sizes of weights 30 can be quickly swapped in and out during an exercise routine.

The rotating pivot collar 18 allows for the centered mass to be rotated around the pivot axle, or central post 12. When the locking tabs 230 are aligned in the locking channels 232, the collar 18 is anchored to the post 12, keeping the weight 30 locked and secure.

In these implementations, the weight 30 stays centered on the device 10 whether placed under the handles 26, 28 or when rotated and locked in front of the handles 26, 28 or when used in free rotation mode. It is understood that in various implementations, the device 10 can be configured such that the weight can be locked in a variety of rotational positions around the axis of the 12, from 0-360 degrees.

Figure 5F:
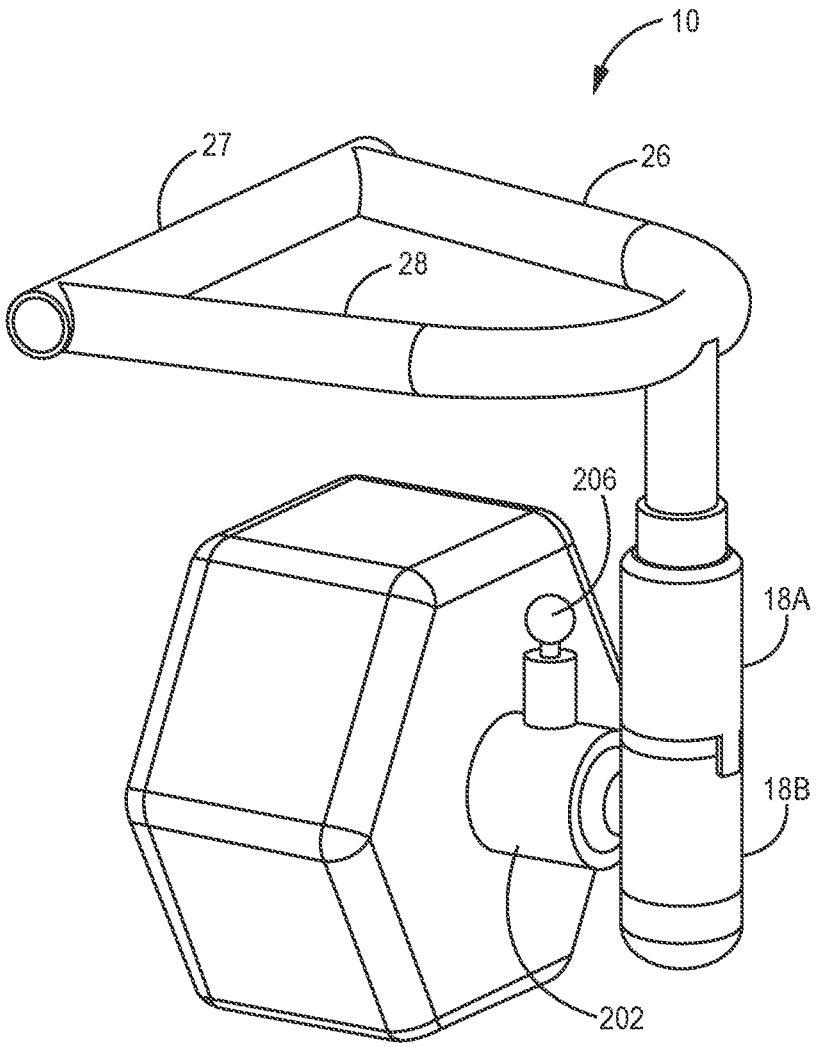
FIG. 5F is a perspective view of an alternate implementation of the bi-bell, having a D-handle.

As shown in the implementation of FIG. 5F, the handles 26, 28 may be connected by a crossbar 27, and the push button 206 can be mounted perpendicular to the mating cylinder 202. In these and the above implementations, again, springs or other tension devices can be disposed within the body to secure the pin 206 into a "locked" configuration, such that the weight 30 is secured to the rest of the bi-bell 10.

Because of the dual handles 26, 28 and the center crossbar 27, the athlete has more stability and control when switching the swinging bi-bell 10 from one hand to the other. This allows for heavier weights to be used and faster rep speeds to be attained all while being safer than a single-handled device.

The device can be gripped by the athlete's right or left hand separately to perform a wide array of single-handed exercises or it can be held with both hands simultaneously to provide a whole new group of exercises not possible with single grip.

Figure 5G:
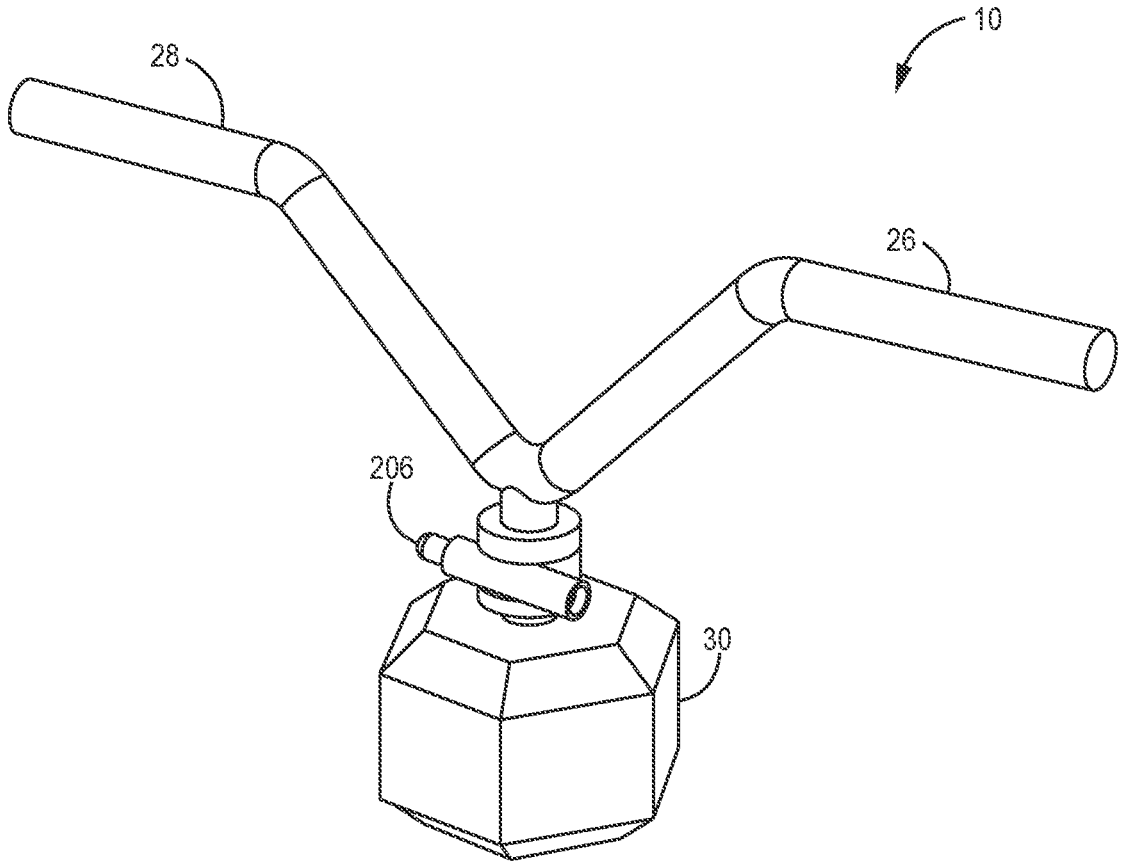
FIG. 5G is a perspective view of an alternate implementation of the bi-bell having a curl bar handle.

In the implementation of FIG. 5G, yet a further handle 26, 28 configuration is being associated with the weight 30.

Figure 5H:
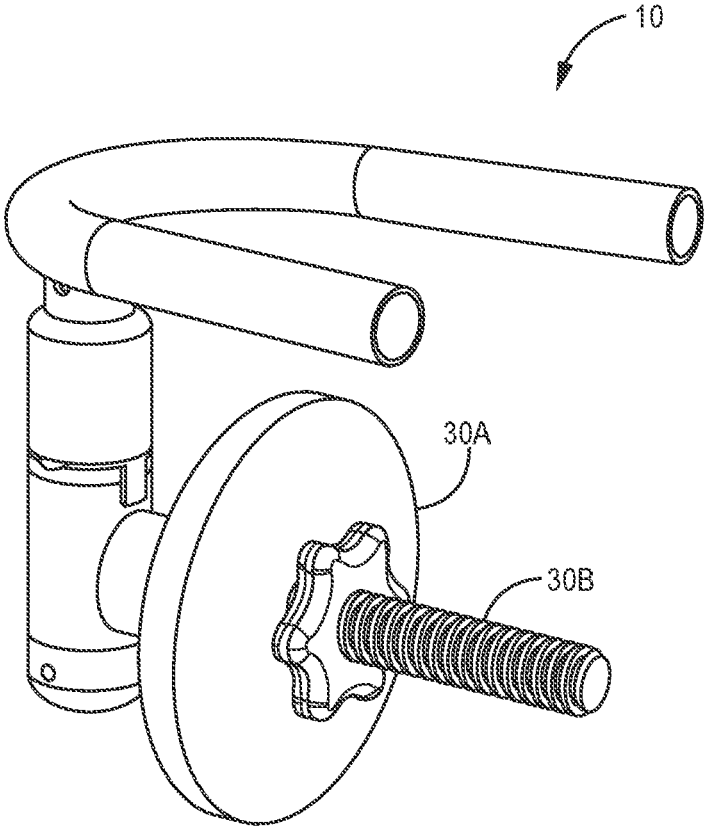
FIG. 5H is a perspective view of an alternate implementation of the bi-bell having a removable plate.

In the implementation of FIG. 5H, a plate weight 30A is secured to the bi-bell via a threaded plate rod and fastener.

Although the disclosure has been described with reference to preferred embodiments, persons skilled in the art will recognize that changes may be made in form and detail without departing from the spirit and scope of the disclosed apparatus, systems and methods.

What is claimed is:

1. A handheld exercise device comprising:

a. an elongate central post comprising a first post end and a second post end;

b. at least one handle disposed at the first post end and respectively extending non-collinearly away from the elongate central post;

c. a weight disposed proximate to the second post end, an entirety of the weight being spaced a distance apart from the elongate central post; and d. a coupling being cylindrically shaped, disposed about the elongate central post, and being constructed and arranged to secure the weight to the elongate central post.

2. The handheld exercise device of claim 1, wherein the weight is constructed and arranged to be selectively rotatable relative to the elongate central post.

3. The handheld exercise device of claim 1, wherein the coupling is constructed and arranged for selective securement of the weight to the elongate central post.

4. The handheld exercise device of claim 1, wherein the at least one handle has first and second grasping portions.

5. A bi-bell exercise device comprising:

a. an elongate central post comprising a first post end and a second post end;

b. at least one handle affixed to the first post end and respectively extending non-collinearly away from the elongate central post;

c. a collar being cylindrically shaped and disposed about the elongate central post; and d. a weight disposed proximate to the second post end, an entirety of the weight being spaced a distance apart from the elongate central post;

wherein the weight is configured to be selectively rotatable relative to the elongate central post via the collar; and wherein the weight is constructed and arranged to be selectively uncoupled from the elongate central post.

6. The bi-bell exercise device of claim 5, further comprising a collar fastener.

7. The bi-bell exercise device of claim 5, further comprising a linkage disposed between the weight and the collar.

8. The bi-bell exercise device of claim 5, wherein the weight is removable.

9. The bi-bell exercise device of claim 5, further comprising a collar stop flange disposed at the second post end of the elongate central post.

* * * * *